US009689182B2

(12) United States Patent
Kuriyama et al.

(10) Patent No.: US 9,689,182 B2
(45) Date of Patent: Jun. 27, 2017

(54) VEHICLE DOOR LATCH CONTROLLER

(71) Applicant: KABUSHIKI KAISHA HONDA LOCK, Miyazaki-Shi, Miyazaki (JP)

(72) Inventors: Kazuyuki Kuriyama, Miyazaki (JP); Tomonori Kamimura, Miyazaki (JP); Yu Nishio, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 127 days.

(21) Appl. No.: 14/427,082

(22) PCT Filed: Aug. 15, 2013

(86) PCT No.: PCT/JP2013/071963
§ 371 (c)(1),
(2) Date: Mar. 10, 2015

(87) PCT Pub. No.: WO2014/041958
PCT Pub. Date: Mar. 20, 2014

(65) Prior Publication Data

US 2015/0240534 A1 Aug. 27, 2015

(30) Foreign Application Priority Data

Sep. 13, 2012 (JP) ..... 2012-201978

(51) Int. Cl.
*E05C 3/06* (2006.01)
*E05B 81/06* (2014.01)
(Continued)

(52) U.S. Cl.
CPC ..... *E05B 81/06* (2013.01); *E05B 79/20* (2013.01); *E05B 81/14* (2013.01); *E05B 81/16* (2013.01);
(Continued)

(58) Field of Classification Search
CPC ..... E05B 81/14; E05B 81/64; E05B 81/66; Y10T 292/1021; Y10S 292/23
(Continued)

(56) References Cited

U.S. PATENT DOCUMENTS 8,533,998 B2 9/2013 Nishikibe et al.
2010/0045051 A1* 2/2010 Berghahn ..... E05B 81/14 292/144
2010/0270815 A1 10/2010 Shinoda et al.

FOREIGN PATENT DOCUMENTS

CN 201087627 7/2008
JP H06-167155 A 6/1994
(Continued)

OTHER PUBLICATIONS

Official Communication dated May 31, 2016 for corresponding European Application EP 13 83 7858.
(Continued)

*Primary Examiner* — Mark Williams
(74) *Attorney, Agent, or Firm* — Carrier Blackman & Associates, P.C.; Joseph P. Carrier; Jeffrey T. Gedeon

(57) ABSTRACT

A vehicle door latch controller is provided in which the operation of a latch release electric motor for driving a ratchet is controlled so as to pivot the ratchet from the ratchet engagement position to the ratchet release position in response to detecting a latch release intention of the vehicle driver in a fully-latched state, wherein a control unit actuates the latch release electric motor so as to pivot the ratchet to the ratchet engagement position after a predetermined time has elapsed since it has detected that the ratchet is at the ratchet release position and actuation of the latch release electric motor has been stopped after the latch release electric motor has started actuating so as to pivot the ratchet from the ratchet engagement position to the ratchet release
(Continued)

position. Such controller prevents opening a door undesirably, even if releasing of a latched state is erroneously carried out.

2 Claims, 16 Drawing Sheets

(51) Int. Cl.

| | |
|---|---|
| ***E05B 79/20*** | (2014.01) |
| ***E05B 81/14*** | (2014.01) |
| ***E05B 81/16*** | (2014.01) |
| ***E05B 81/34*** | (2014.01) |
| ***E05B 81/66*** | (2014.01) |
| ***E05B 81/68*** | (2014.01) |
| ***E05B 85/12*** | (2014.01) |
| ***E05B 81/64*** | (2014.01) |
| ***E05B 81/42*** | (2014.01) |
| ***E05B 81/54*** | (2014.01) |
| ***E05B 85/24*** | (2014.01) |

(52) U.S. Cl.
CPC ..... *E05B 81/34* (2013.01); *E05B 81/42* (2013.01); *E05B 81/54* (2013.01); *E05B 81/64* (2013.01); *E05B 81/66* (2013.01); *E05B 81/68* (2013.01); *E05B 85/12* (2013.01); *E05B 85/243* (2013.01); *Y10T 292/1082* (2015.04)

(58) Field of Classification Search
USPC ..... 292/201
See application file for complete search history.

(56) References Cited

FOREIGN PATENT DOCUMENTS

| | | |
|---|---|---|
| JP | 2002-121947 A | 4/2002 |
| JP | 2011-026832 A | 2/2011 |

OTHER PUBLICATIONS

Official Communication dated Feb. 2, 2016 corresponding to Chinese Patent Application No. 201380047491.9.

* cited by examiner

VEHICLE DOOR LATCH CONTROLLER

TECHNICAL FIELD

The present invention relates to a vehicle door latch controller that includes a latch that, in response to pivoting of a door to a closed side, engages with a striker on a vehicle body side and pivots, a ratchet that can operate between a ratchet engagement position in which engagement with the latch in a completely closed state and a half-shut state of the door is enabled and a ratchet release position in which engagement with the latch is released, a latch release electric motor that exerts power for driving the ratchet between the ratchet engagement position and the ratchet release position, latch release intention detection means that detects a latch release intention of a vehicle driver for the door, and a control unit that controls actuation of the latch release electric motor so as to pivot the ratchet from the ratchet engagement position to the ratchet release position in response to the latch release intention detection means detecting a latch release intention of the vehicle driver in a fully-latched state in which the ratchet is engaged with the latch when the door is completely closed.

BACKGROUND ART

A vehicle door latch controller in which, in response to a vehicle driver opening a door in a fully-latched state in which a locking plate (corresponding to the ratchet of the invention of the present application) is engaged with a latch in a completely closed state of the door, an electric motor actuates so as to drive the locking plate to the side that releases engagement with the latch, when it is detected that the locking plate has been operated to an engagement release position where engagement with the latch is released, actuation of the electric motor is stopped and the locking plate is maintained at the engagement release position, and in response to the door being opened the electric motor is actuated so as to drive the locking plate to a position where engagement with the latch is enabled is known from Patent Document 1.

RELATED ART DOCUMENTS

Patent Documents

Patent Document 1: Japanese Patent Application Laid-open No. 6-167155

SUMMARY OF THE INVENTION

Problems to be Solved by the Invention

In order to maintain the door at the closed position, it is necessary for the locking plate to be in a position where engagement with the latch is enabled when the door is pivoted to the closed position side; when, immediately after the locking plate is driven to the engagement release position in order to release a state of engagement of the locking plate with the latch and enable the door to be opened, the locking plate is returned to the position where engagement with the latch is enabled, if the door is not immediately opened after driving the locking plate to the engagement release position to thus release the latched state, the door opens slightly due to the reaction force of a waterproof seal present between the vehicle body and the door in a door closed state, and the locking plate is then engaged with the latch to thus attain a half-shut state; in order to open the door it is necessary for the vehicle driver to carry out an opening operation of the door again to thus operate the locking plate to the engagement release position. In order to avoid such a redundant operation, in the arrangement disclosed in Patent Document 1 above, the locking plate is maintained at the engagement release position until the door is opened after the latched state is released.

However, in the arrangement disclosed in Patent Document 1, the locking plate is maintained at the engagement release position as long as the door is not completely opened (as long as the striker is not disengaged from the latch); if a door opening operation is erroneously carried inadvertently using an inside switch, etc. without the intention to open the door while in the vehicle, the locking plate remains at the engagement release position, the door does not attain a half-shut state, and if the vehicle is traveling in that state there is a possibility that the door will open undesirably.

The present invention has been accomplished in light of such circumstances, and it is an object thereof to provide a vehicle door latch controller that can prevent to the utmost the occurrence of a situation of a door opening undesirably, even if an operation of releasing a latched state is erroneously carried out.

Means for Solving the Problems

In order to attain the above object, according to a first aspect of the present invention, there is provided a vehicle door latch controller comprising a latch that, in response to pivoting of a door to a closed side, engages with a striker on a vehicle body side and pivots, a ratchet that can operate between a ratchet engagement position in which engagement with the latch in a completely closed state and a half-shut state of the door is enabled and a ratchet release position in which engagement with the latch is released, a latch release electric motor that exerts power for driving the ratchet between the ratchet engagement position and the ratchet release position, latch release intention detection means that detects a latch release intention of a vehicle driver for the door, and a control unit that controls actuation of the latch release electric motor so as to pivot the ratchet from the ratchet engagement position to the ratchet release position in response to the latch release intention detection means detecting a latch release intention of the vehicle driver in a fully-latched state in which the ratchet is engaged with the latch when the door is completely closed, characterized in that the vehicle door latch controller comprises ratchet release position detection means that detects a state in which the ratchet is at the ratchet release position and inputs the state to the control unit, and the control unit actuates the latch release electric motor so as to pivot the ratchet to the ratchet engagement position after a predetermined time has elapsed since the ratchet release position detection means has detected that the ratchet is at the ratchet release position and actuation of the latch release electric motor has been stopped after the latch release electric motor has started actuating so as to pivot the ratchet from the ratchet engagement position to the ratchet release position.

Further, according to a second aspect of the present invention, in addition to the first aspect, the vehicle door latch controller comprises door open detection means that detects that the door has opened, and the control unit actuates the latch release electric motor so as to immediately pivot the ratchet toward the ratchet engagement position side when the door open detection means detects pivoting of the door toward the open side before the predetermined time has elapsed since the ratchet release position detection means has detected that the ratchet is at the ratchet release position and actuation of the latch release electric motor has been stopped.

An unlatched switch 49 of an embodiment corresponds to the door open detection means of the present invention, latch release intention detection switches 118 and 119 of the embodiment correspond to the latch release intention detection means of the present invention, a ratchet release position cam switch 121 or a ratchet switch 51 of the embodiment corresponds to the ratchet release position detection means of the present invention, a latch control unit 122 of the embodiment corresponds to the control unit of the present invention, and a first predetermined time T1 of the embodiment corresponds to the predetermined time of the present invention.

Effects of the Invention

In accordance with the first aspect of the present invention, since the ratchet is pivoted to the ratchet engagement position after the predetermined time has elapsed since the ratchet has been pivoted to the ratchet release position in order to release the latched state, even if an operation of releasing the latched state is erroneously carried out, after the predetermined time has elapsed the ratchet can be engaged with the latch to thus put the door in a half-shut state, thereby preventing to the utmost the occurrence of a situation of the door opening undesirably.

Furthermore, in accordance with the second aspect of the present invention, when the door is closed (quickly closed) before the predetermined time has elapsed after the latched state has been released and the door has been opened, if the ratchet were at the ratchet release position, the door could not have been maintained in a closed state, but since the ratchet is immediately driven to the ratchet engagement position when the door has opened before the predetermined time has elapsed after the ratchet has attained the ratchet release position, even if the door is closed quickly, the ratchet can be made to engage with the latch, thus maintaining the door in a closed state.

EXPLANATION OF REFERENCE NUMERALS AND SYMBOLS

Figure 1:
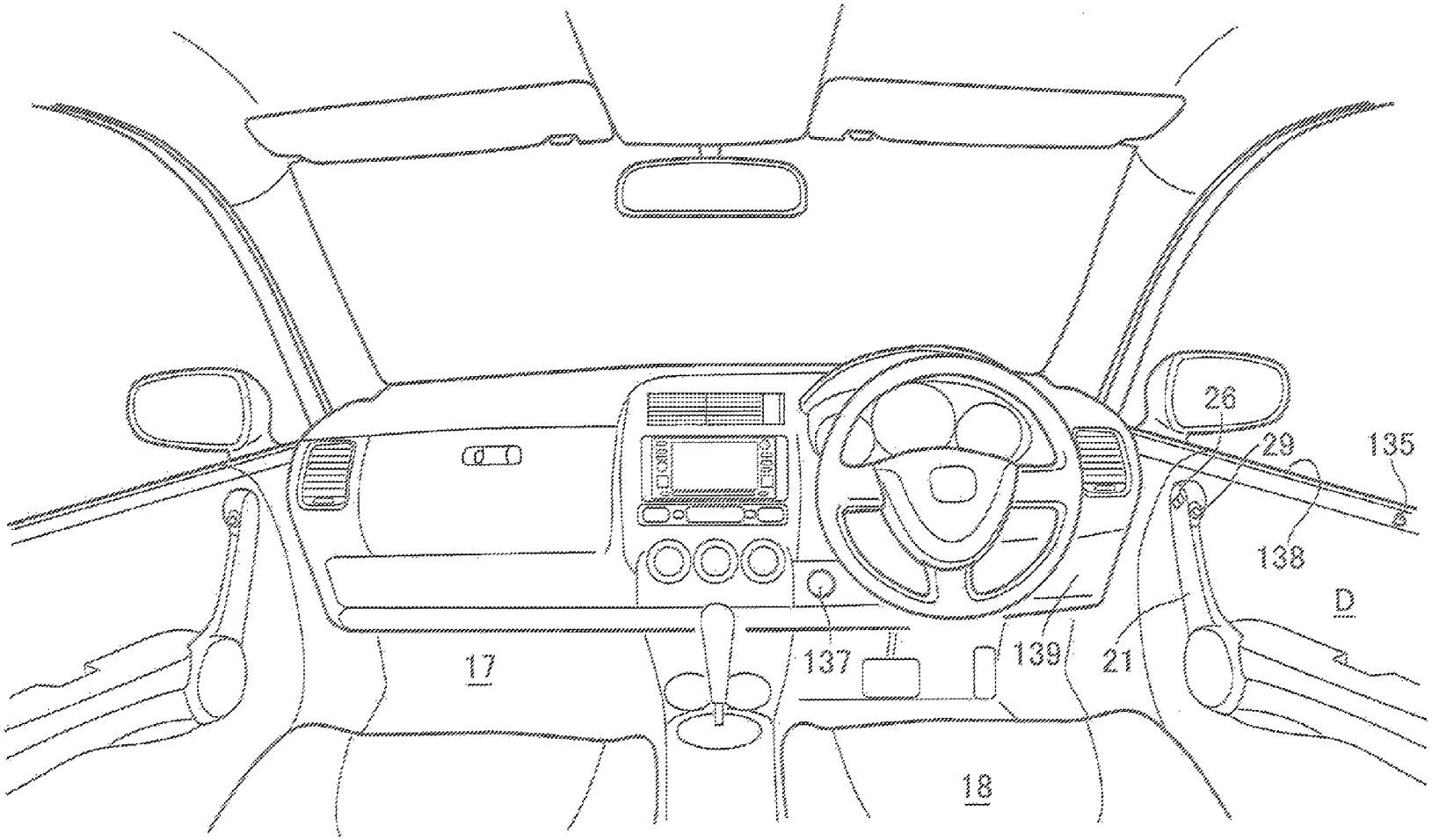
FIG. 1 is a view from the rear of a front part within a vehicle compartment of a passenger vehicle. (first embodiment)

24 Latch release electric motor
33 Striker
40 Latch
41 Ratchet
49 Unlatched switch, which is door open detection means
51 Ratchet switch, which is ratchet release position detection means
118, 119 Latch release intention detection switch, which is latch release intention detection means
121 Ratchet release position cam switch, which is ratchet release position detection means
122 Latch control unit, which is a control unit
T2 Second predetermined time

MODE FOR CARRYING OUT THE INVENTION

A mode for carrying out the present invention is explained below by reference to the attached FIG. 1 to FIG. 16.

First Embodiment

First, in FIG. 1, a driver's seat 18 is disposed on for example the front right side in the interior of a vehicle compartment 17 of a passenger vehicle, and an inside handle 21 is provided on an inner face of a front side door D on the driver's seat 18 side, the inside handle 21 being for a vehicle user on the driver's seat 18 to open and close the front side door D.

Figure 2:
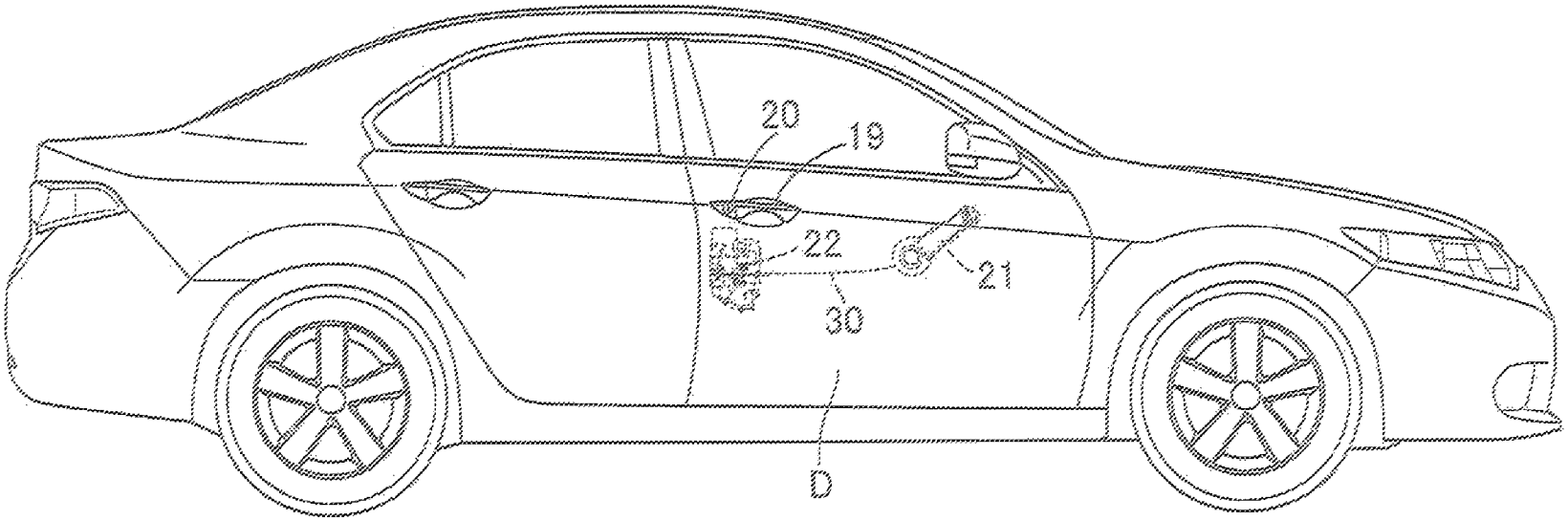
FIG. 2 is a right side view of the passenger vehicle. (first embodiment)

Referring in addition to FIG. 2, an outside handle 19 for opening and closing the front side door D is provided on an outer face of the front side door D on the driver's seat 18 side, and this outside handle 19 is equipped with a cylinder lock 20. Furthermore, a latch mechanism 22 is disposed on the front side door D of the driver's seat 18 side, the latch mechanism 22 being capable of switching between a latched state in which a closed state of the front side door D is maintained by engagement with the vehicle body side and an unlatched state in which opening of the front side door D is enabled.

Figure 3:
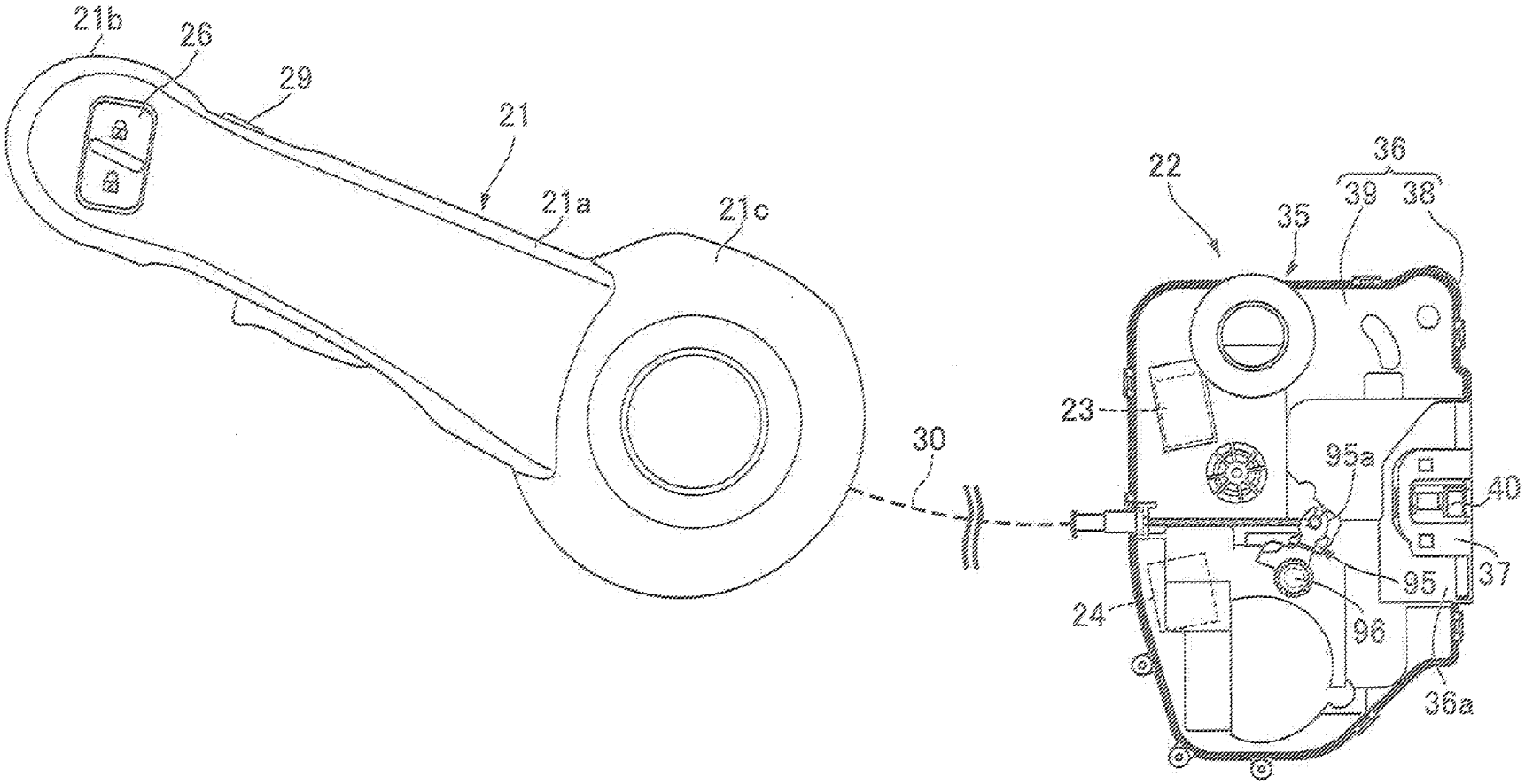
FIG. 3 is a side view from the vehicle compartment side of an inside handle and a latch mechanism of a front side door on a driver's seat side. (first embodiment)

In FIG. 3, the latch mechanism 22 includes a reversible lock/unlock switching electric motor 23 and a latch release electric motor 24, the lock/unlock switching electric motor 23 exerting power for switching between an unlocked state in which release of the latched state is enabled and a locked state in which release of the latched state is disabled, and the latch release electric motor 24 exerting power for releasing the latched state in the unlocked state.

The inside handle 21 is formed from a grip portion 21*a* extending lengthwise in the fore-and-aft direction of the vehicle, a circular front support portion 21*b* provided so as to be connected to the front end of the grip portion 21*a*, and a rear support portion 21*c* formed to be a larger circle than the front support portion 21*b* and provided so as to be connected to the rear end of the grip portion 21*a*, the front support portion 21*b* and the rear support portion 21*c* of the inside handle 21, which is inclined upwardly to the front, being fixed to the inner face side of the driver's seat-side side door D.

Disposed on a face of the front support portion 21*b* of the inside handle 21 that faces the interior of the vehicle compartment is a lock/unlock switching switch 26 for switching between the locked state and the unlocked state of the latch mechanisms 22 of all of the doors, including the side door D on the driver's seat 18 side of the passenger vehicle.

Furthermore, a push button 29 is disposed on a front upper side of the grip portion 21*a* of the inside handle 21; the vehicle user may push in the push button 29 when actuating the latch release electric motor 24 of the latch mechanism 22, and a cable 30 that is pulled in response to the push button 29 being pushed in extends from the inside handle 21 to the latch mechanism 22 side.

Figure 4:
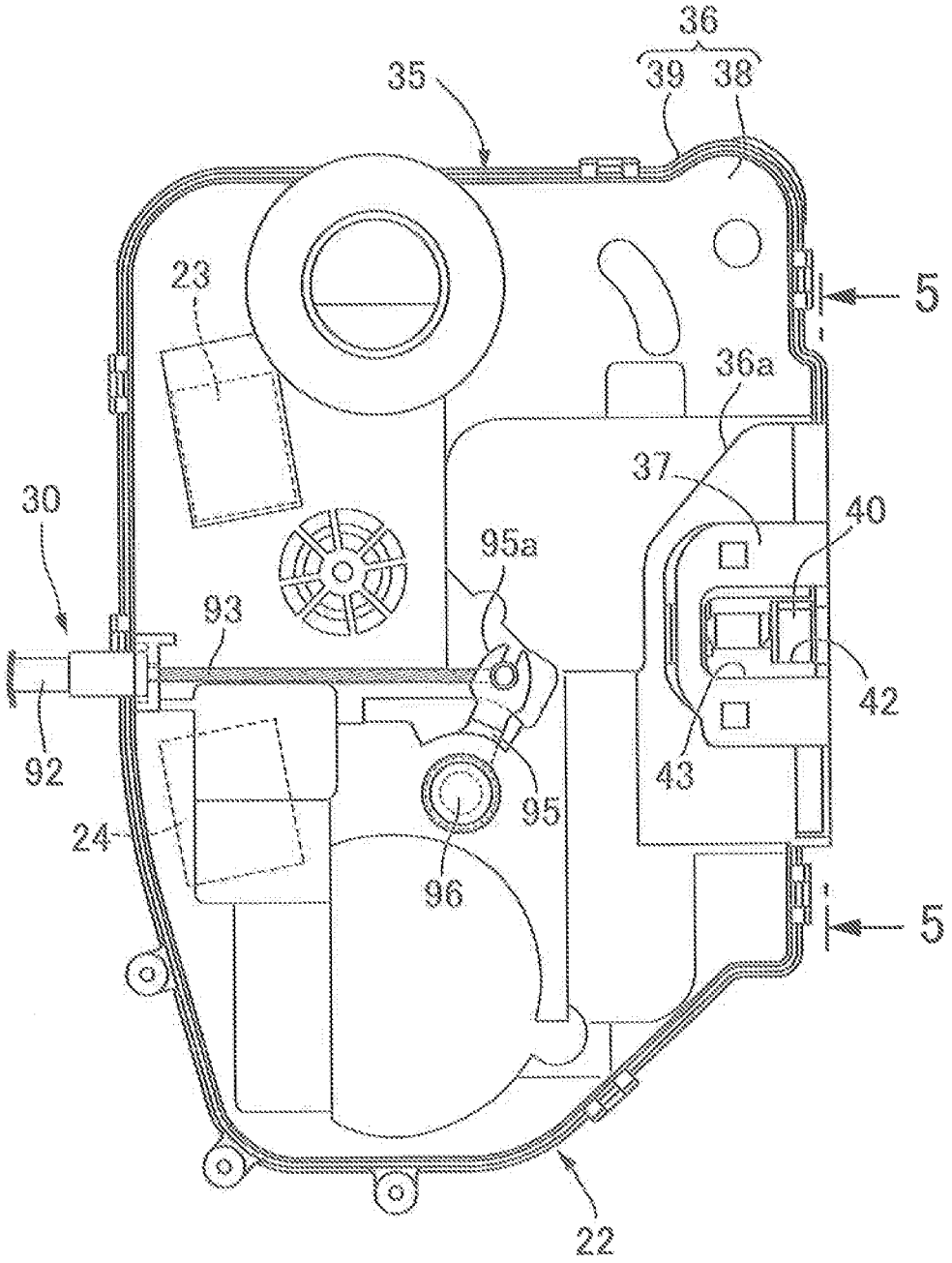
FIG. 4 is an enlarged side view of the latch mechanism. (first embodiment)

Referring in addition to FIG. 4, a casing 35 of the latch mechanism 22 has a housing case 36 that houses the lock/unlock switching electric motor 23 and the latch release electric motor 24, and a cover plate 37 that is made of metal and mounted on the housing case 36. The housing case 36 is formed from a case main body 38 that is formed from a synthetic resin into a box shape opening toward the vehicle compartment 17 side, and a cover member 39 that is made of a synthetic resin and detachably mounted on the case main body 38 so as to close the open end of the case main body 38; a projecting portion 36*a* is provided integrally with the housing case 36, the projecting portion 36*a* projecting toward the inner face side of the front side door D on the free end side of the front side door D, and the cover plate 37 is mounted on the projecting portion 36*a*.

Figure 5:
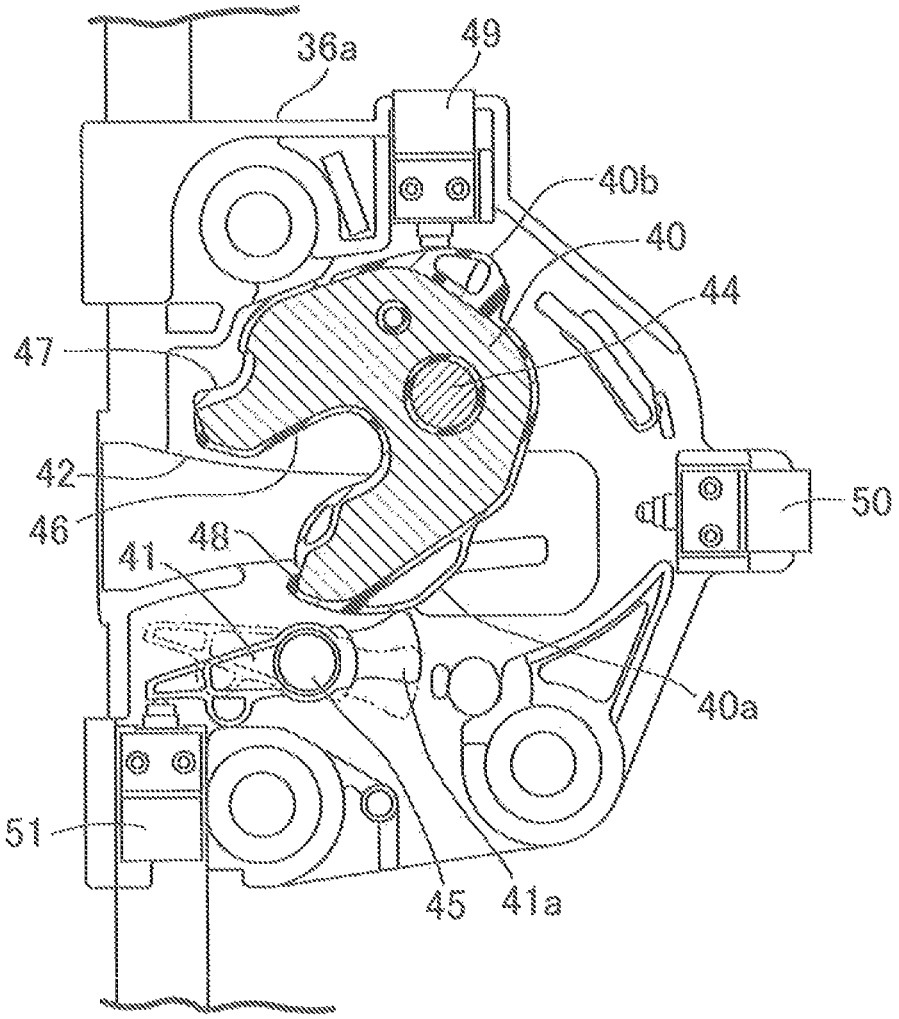
FIG. 5 is a view along line 5-5 in FIG. 4 in a door-opened state of part of the latch mechanism with a cover plate detached from a casing. (first embodiment)
Figure 6:
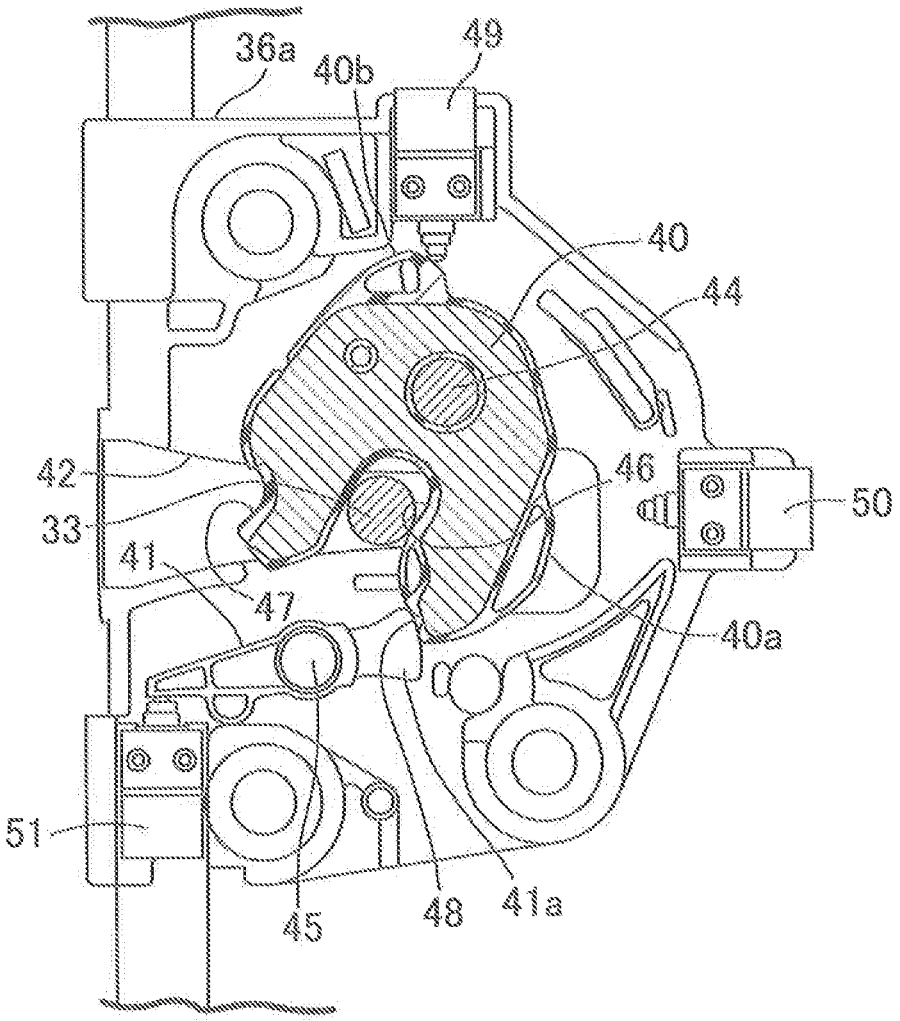
FIG. 6 is a view, corresponding to FIG. 5, in a half-shut state. (first embodiment)
Figure 7:
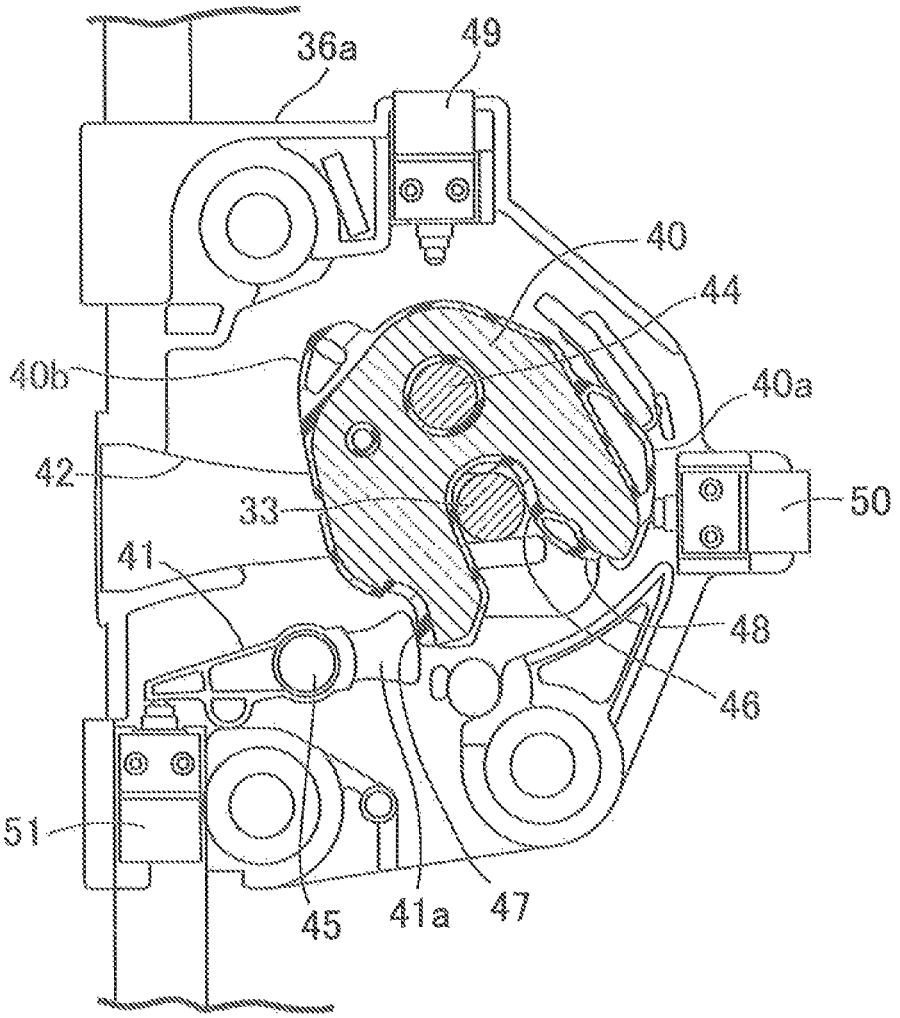
FIG. 7 is a view, corresponding to FIG. 5, in a fully-latched state. (first embodiment)

In FIG. 5, housed between the projecting portion 36*a* and the cover plate 37 are a latch 40 and a ratchet 41 that can engage with the latch 40 so as to maintain a pivoting position of the latch 40, the latch 40 being capable of pivoting in a door closing direction (the counterclockwise direction in FIG. 5) by engagement with a striker 33 fixed on the vehicle body side (see FIG. 6 and FIG. 7).

An approach groove 42 for the striker 33 to enter is formed in the projecting portion 36*a*, and an opening 43 corresponding to the approach groove 42 is provided in the cover plate 37. The latch 40 is pivotably supported by a first support shaft 44 provided between the cover plate 37 and the projecting portion 36*a*. Furthermore, a second support shaft 45 having an axis parallel to the first support shaft 44 is provided on the cover plate 37 and the projecting portion 36*a* at a position at which the approach groove 42 is present between the second support shaft 45 and the first support shaft 44, and the ratchet 41 is pivotably supported on the second support shaft 45.

The latch 40 is pivotingly urged in the door opening direction (the clockwise direction in FIG. 5) by means of a spring (not illustrated) provided in a compressed state between the latch 40 and the projecting portion 36*a*. Provided on an outer peripheral part of the latch 40 are an engagement groove 46, a full engagement step part 47, and a half engagement step part 48. The striker 33 entering the approach groove 42 engages with the engagement groove 46 when the latch 40 is present at the end of pivoting in the door opening direction.

On the other hand, the ratchet 41 is provided integrally with an engagement arm portion 41*a* projecting toward the latch 40 side so that the engagement arm portion 41*a* can engage with the full engagement step part 47 and the half engagement step part 48 of the latch 40. This ratchet 41 is pivoted by actuation of the latch release electric motor 24 between a ratchet engagement position shown by the solid line in FIG. 5 and a ratchet release position shown by the chain line in FIG. 5. Moreover, a ratchet lever 58 shown in FIG. 8 described below is operatively linked to the ratchet 41 so as to pivot together with the ratchet 41.

In a state in which the ratchet 41 is present at the ratchet engagement position, when the latch 40 is present at the end of pivoting in the door opening direction (the pivoting position shown in FIG. 5) the engagement arm portion 41*a* of the ratchet 41 is in contact with a first elastic bulge portion 40*a* provided on the outer periphery of the half engagement step part 48 of the latch 40; when the latch 40 is pushed by the striker 33 entering the approach groove 42 and pivots in the door closing direction (the counterclockwise direction in FIG. 5), as shown in FIG. 6 the striker 33 engages with the engagement groove 46 and the engagement arm portion 41*a* engages with the half engagement step part 48, thereby maintaining a half-shut state for the front side door D and attaining a half-latched state. Furthermore, when the latch 40 pivots further in the door closing direction in response to the striker 33 engaged with the engagement groove 46 entering further into the interior of the approach groove 42, as shown in FIG. 7 the ratchet 41 makes the engagement arm portion 41*a* engage with the full engagement step part 47, and the front side door D is locked in a completely door closed state, thus attaining a fully-latched state.

When the ratchet 41 is pivoted from the ratchet engagement position to the ratchet release position in the fully-latched state, the latch mechanism 22 attains an unlatched state, a waterproof seal present between the front side door D and the vehicle body when the door D is in a closed state exerts a reaction force to thus very slightly open the front side door D, and in response thereto the latch 40 also slightly pivots in the door opening direction; in response to an operating force in the opening direction being applied to the front side door D the striker 33 moves in the interior of the approach groove 42, and in response thereto the latch 40 pivots to the end of pivoting in the door opening direction shown in FIG. 5.

While the latch 40 is at a pivoting position from the end of pivoting in the door opening direction shown in FIG. 5 to immediately before the half-latched state shown in FIG. 6, that is, when a latched state of the front side door D is released and it is opened, an unlatched switch 49 that is mounted on the projecting portion 36*a* of the housing case 36 abuts against a second elastic bulge portion 40*b* provided on the outer periphery of the latch 40 and attains an ON state, and a fully-latched switch 50 that, when the latch 40 reaches the end of pivoting in the door closing direction as shown in FIG. 7, abuts against the first elastic bulge portion 40*a* on the outer periphery of the latch 40 and attains an ON state is also mounted on the projecting portion 36*a* of the housing case 36. Furthermore, mounted on the projecting portion 36*a* is a ratchet switch 51 that abuts against the ratchet 41 and attains an ON state in a state in which the ratchet 41 is at the ratchet engagement position.

Figure 8:
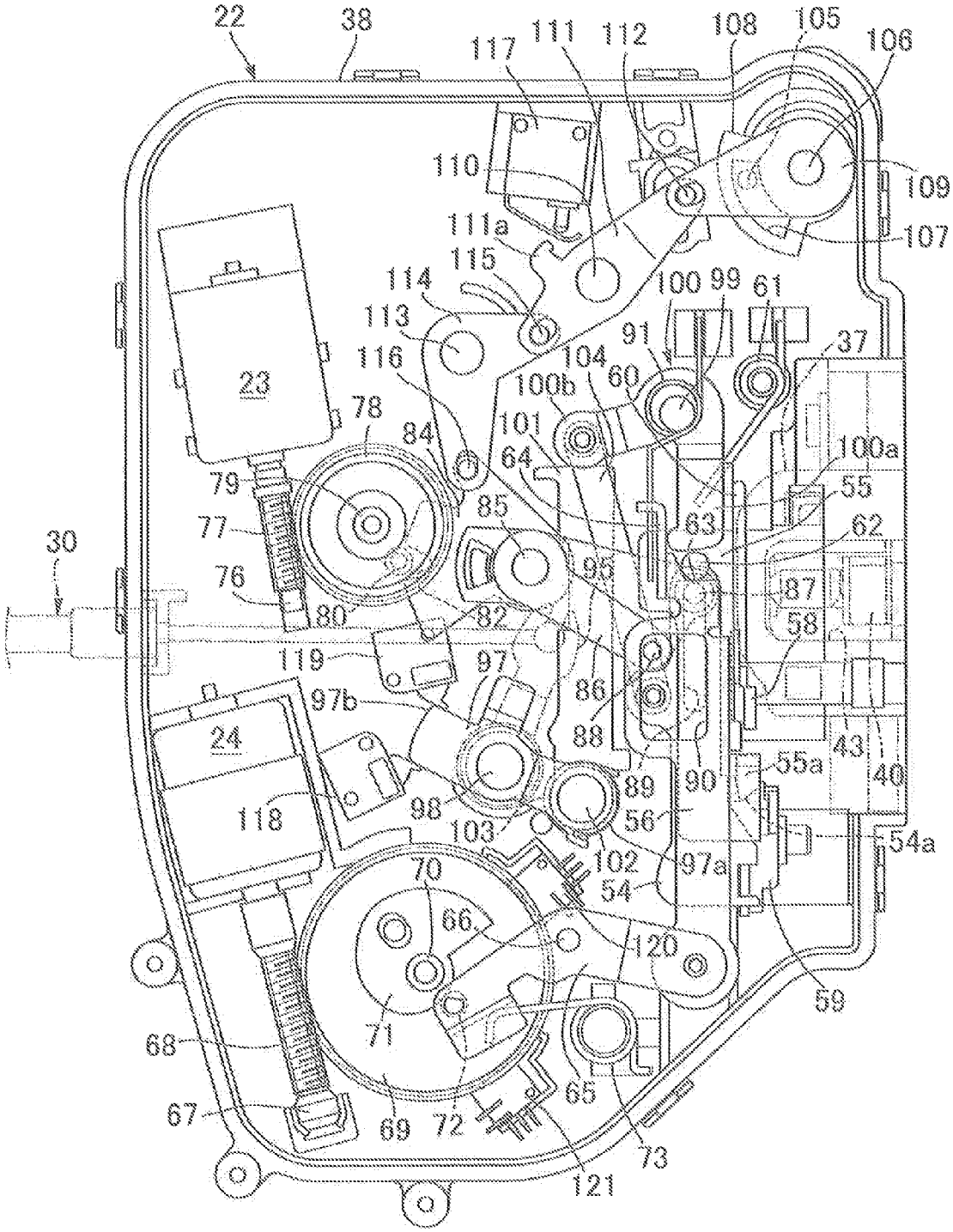
FIG. 8 is a side view of an essential part showing part of the latch mechanism in an unlocked state with a cover member and the cover plate detached from the casing. (first embodiment)

In FIG. 8, in an area close to the cover plate 37 within the case main body 38 in the housing case 36, an open link 54, a release link 55, and a first cancel lever 56 are disposed so as to be superimposed one another in sequence from the side opposite to the cover member 39. When the open link 54 or the release link 55 moves upward while being in a vertically extending attitude and, from below, abuts against and engages with the ratchet lever 58, which pivots together with the ratchet 41, to thus pivot the ratchet lever 58, the ratchet 41 pivots from the ratchet engagement position to the ratchet release position, this allows the latch 41 to pivot in the door opening direction, and a latched state of the front side door D is released.

An open lever 59 is pivotably supported on a lower part of the cover plate 37 side of the case main body 38, the open lever 59 pivoting in response to operation of the outside handle 19 disposed on the outer face side of the front side door D, a lower end part of the open link 54 is linked to the open lever 59 so as to allow the open link 54 to pivot, and the open link 54 operates vertically in response to pivoting of the open lever 59. Moreover, provided on the open link 54 is a pressing portion 54*a* that can abut against and engage with the ratchet lever 58 from below when the open link 54 is in a vertically extending attitude as shown in FIG. 8.

Furthermore, the release link 55 is supported on the case main body 38 in a vertically operable manner, a guide wall 60 for guiding vertical movement of the release link 55 is provided on the case main body 38 so as to be disposed between the release link 55 and the cover plate 37, and a torsion spring 61 that urges the release link 55 toward the side on which it is put into sliding contact with the guide wall 60 is provided between the case main body 38 and the release link 55. Moreover, a link pin 62 is implanted in an upper part of the release link 55, and a pressing portion 55*a* that can abut against and engage with the ratchet lever 58 from below is provided on the release link 55.

Formed on an upper end part of the first cancel lever 56 is an abutment face 63 that can abut against the link pin 62 from below on the side opposite to the guide wall 60, and provided on the upper end part of the first cancel lever 56 is a latching plate part 64 opposing the link pin 62 from the side opposite to the cover plate 37.

One end part of a release lever 65 is pivotably linked to a lower end part of the first cancel lever 56, and an intermediate part of the release lever 65 is pivotably supported on the case main body 38 via a third support shaft 66 so as to vertically operate the first cancel lever 56.

The latch release electric motor 24 is fixedly disposed on the case main body 38, and a worm wheel 69 meshing with a worm gear 68 provided on an output shaft 67 of the latch release electric motor 24 is pivotably supported on the case main body 38 via a fourth support shaft 70 having an axis parallel to the third support shaft 66. A cam 71 pivoting together with the worm wheel 69 is provided on the worm wheel 69, and a pin 72 in sliding contact with the cam 71 is implanted in the other end part of the release lever 65. Moreover, a torsion spring 73 pivotingly urging the release lever 65 in a direction that puts the pin 72 into sliding contact with the cam 71 is provided between the case main body 38 and the release lever 65.

When the latch release electric motor 24 actuates so as to pivot the worm wheel 69 and the cam 71 in the counterclockwise direction in FIG. 8, due to the pin 72 being in sliding contact with the cam 71 the release lever 65 pivots in the counterclockwise direction in FIG. 8, and the first cancel lever 56 is pushed upward. The cam 71 is formed such that the force pushing the first cancel lever 56 upward is released in response to the latch release electric motor 24 actuating so as to pivot the cam 71 further in the counterclockwise direction in FIG. 8 after the first cancel lever 56 is pushed upward, and the first cancel lever 56 accordingly descends downward.

The lock/unlock switching electric motor 23 is fixedly disposed on an upper part of the case main body 38 above the latch release electric motor 24, and a worm wheel 78 meshing with a worm gear 77 provided on an output shaft 76 of the lock/unlock switching electric motor 23 is pivotably supported on the case main body 38 via a fifth support shaft 79 parallel to the fourth support shaft 70. An engagement projection 80 is provided on the worm wheel 78 so as to be offset from the central axis, a fan-shaped first locking lever 84 having on the outer periphery a latching recess part 82 that the engagement projection 80 can engage with is pivotably supported on the case main body 38 via a sixth support shaft 85 parallel to the fifth support shaft 79, and a second locking lever 86 pivoting together with the first locking lever 84 is also pivotably supported on the case main body 38 via the sixth support shaft 85.

Provided on the second locking lever 86 are a first pin 87 inserted through an elongated hole 89 provided in the open link 54 so as to extend in the vertical direction, and a second pin 88 inserted through a rectangular opening 90 provided in the first cancel lever 56. A torsion spring 91 is provided between the case main body 38 and the first cancel lever 56, the torsion spring 91 urging the first cancel lever 56 in the direction in which the side edge, on the side opposite to the cover plate 37, of the opening 90 abuts against the second pin 88.

When in an unlocked state in which latch release of the front side door D is enabled, the lock/unlock switching electric motor 23 stops after pivoting the worm wheel 78 having the engagement projection 80 engaged with the latching recess part 82 to the position shown in FIG. 8, and in this state the second locking lever 86 is in a state in which it has pivoted to the maximum in the counterclockwise direction in FIG. 8 around the axis of the sixth support shaft 85. This puts the open link 54 and the first cancel lever 56 into an attitude in which they extend vertically as shown in FIG. 8, the abutment face 63 on the upper end part of the first cancel lever 56 can abut against the link pin 62 from below and push it upward, and the pressing portion 54*a* of the open link 54 can abut against the ratchet lever 58 from below.

Figure 9:
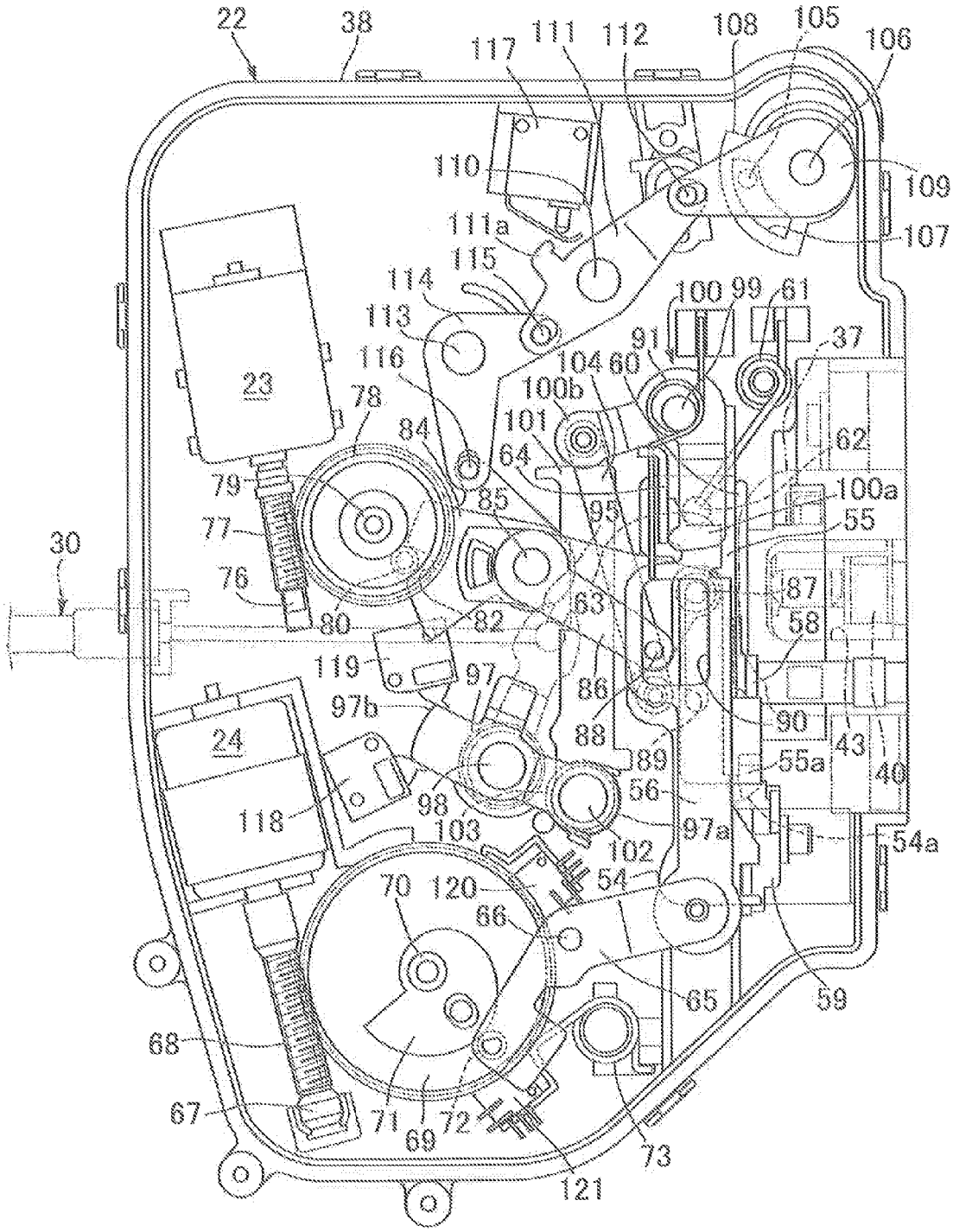
FIG. 9 is a side view, corresponding to FIG. 8, in a latch released state resulting from actuation of a latch release electric motor. (first embodiment)

When, in such an unlocked state, the first cancel lever 56 is pushed upward as shown in FIG. 9 by actuation of the latch release electric motor 24, the abutment face 63 on the upper end part of the first cancel lever 56 abuts against the link pin 62 of the release link 55 from below, in response to the first cancel lever 56 being pushed further upward the release link 55 is also pushed upward, the pressing portion 55*a* of the release link 55 abuts against the ratchet lever 58 from below so as to pivot the ratchet lever 58, and a latched state of the front side door D is released. Furthermore, when, in an unlocked state, the outside handle 19 disposed on the outer face side of the front side door D is operated so as to pivot the open lever 59, the open link 54 is pushed upward, the ratchet lever 58 is pivoted by the pressing portion 54*a* of the open link 54, and this also releases a latched state of the front side door D.

Figure 10:
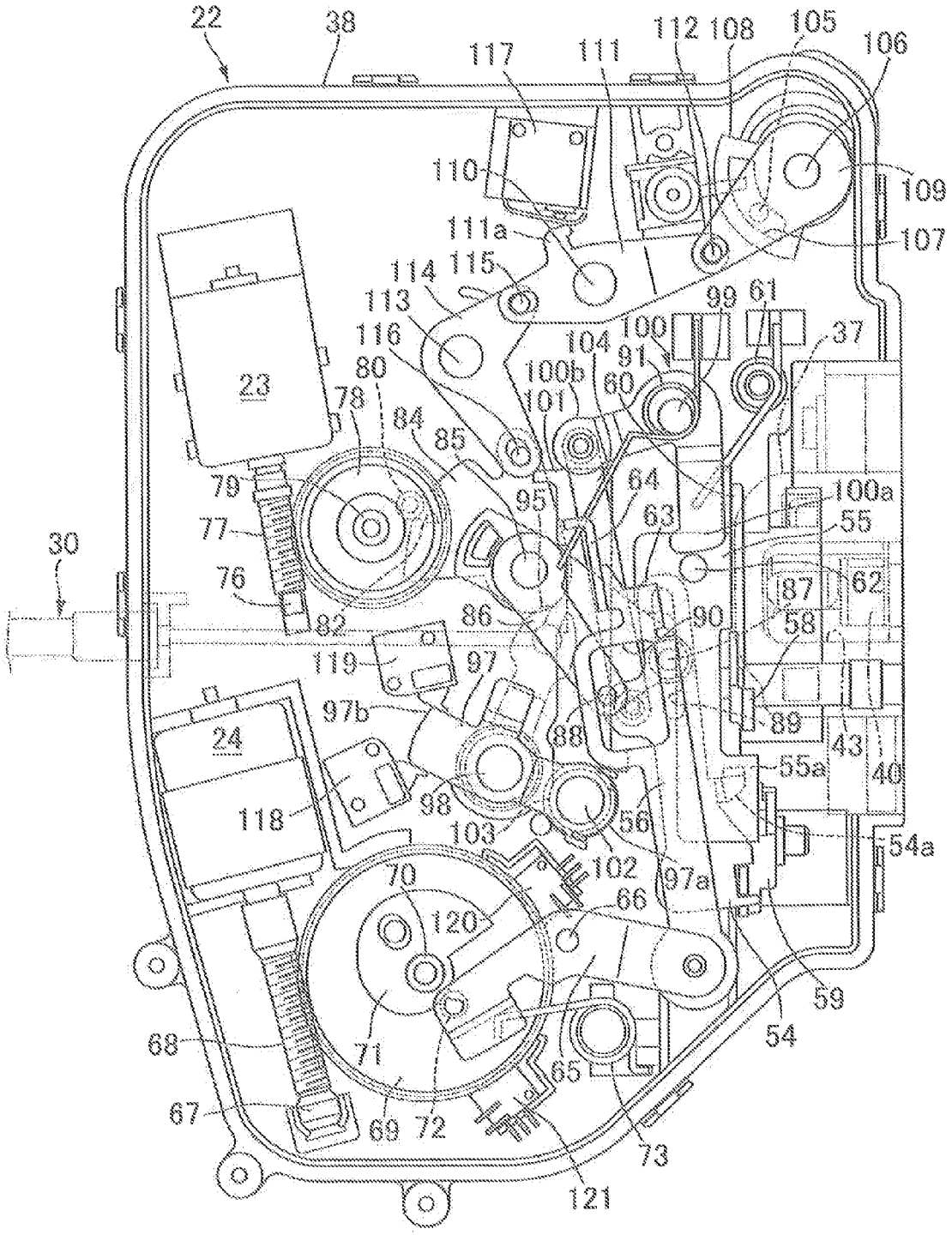
FIG. 10 is a side view, corresponding to FIG. 8, in a locked state. (first embodiment)

When attaining a locked state in which latch release of the front side door D is disabled even by actuation of the latch release electric motor 24 or operation of the outside handle 19, the lock/unlock switching electric motor 23 pivots the worm wheel 78 in the counterclockwise direction from the state of FIG. 8 and stops after pivoting the worm wheel 78 having the engagement projection 80 engaged with the latching recess part 82 to the position shown in FIG. 10, and in this state the second locking lever 86 is in a state in which it has pivoted to the maximum in the clockwise direction in FIG. 10 around the axis of the sixth support shaft 85. This puts the open link 54 and the first cancel lever 56 in an attitude in which they are inclined in a direction away from the guide wall 60 from the attitude in which they extend vertically. In this state, the abutment face 63 on the upper end part of the first cancel lever 56 does not abut against the link pin 62 from below even if the first cancel lever 56 moves upward, and the pressing portion 54*a* of the open link 54 is also at a position where it cannot abut against the ratchet lever 58 from below. Therefore, even if the first cancel lever 56 is pushed upward by actuation of the latch release electric motor 24, the release link 55 does not move upward, and even if the outside handle 19 is operated so as to move the open link 54 upward, the pressing portion 54*a* does not abut against the ratchet lever 58 from below, and the front side door D therefore remains in a latched state.

A first cylinder lever 108 pivoting in response to a key operation of the cylinder lock 20 attached to the outside handle 19 is supported on an upper part of the case main body 38 via a seventh support shaft 106, and an arc-shaped link hole 107 having the axis of the seventh support shaft 106 as its center is provided in the first cylinder lever 108. A second cylinder lever 109, which overlaps the first cylinder lever 108, is supported on the seventh support shaft 106 in a relatively pivotable manner with respect to the first cylinder lever 108, and a link pin 105 inserted through the link hole 107 is implanted in the second cylinder lever 109.

The second cylinder lever 109 is linked, via a link pin 112, to one end part of a third cylinder lever 111 pivotably supported on the case main body 38 via an eighth support shaft 110 having an axis parallel to the seventh support shaft 106. Furthermore, the other end part of the third cylinder lever 111 is linked, via a link pin 115, to one end part of a fourth cylinder lever 114 pivotably supported on the case main body 38 via a ninth support shaft 113 having an axis parallel to the eighth support shaft 110, and the other end part of the fourth cylinder lever 114 is linked to the first locking lever 84 via a link pin 116.

When, in the unlocked state, the cylinder lock 20 is operated toward the lock side, the first cylinder lever 108 pivots in the counterclockwise direction in FIG. 8, the second cylinder lever 109 pivots in the counterclockwise direction in response thereto, the third cylinder lever 111 pivots in the clockwise direction, and the fourth cylinder lever 114 pivots in the counterclockwise direction to thus pivot the first locking lever 84 in the counterclockwise direction to the position shown in FIG. 10. Furthermore, when, in the locked state, the cylinder lock 20 is operated to the unlock side, the first cylinder lever 108 pivots in the clockwise direction in FIG. 10, the second cylinder lever 109 pivots in the clockwise direction in response thereto, the third cylinder lever 111 pivots in the counterclockwise direction, and the fourth cylinder lever 114 pivots in the clockwise direction to thus pivot the first locking lever 84 in the clockwise direction to the position shown in FIG. 8.

The second to fourth cylinder levers 109, 111, and 114 are pivoted by actuation of the lock/unlock switching electric motor 23 in the same manner as when the cylinder lock 20 is operated, and a lock/unlock detection switch 117 for detecting if the latch mechanism 22 is in the unlocked state or the locked state is mounted on the case main body 38 such that its switching mode is changed by contact with and detachment from a detection portion 111*a* provided integrally with the third cylinder lever 111.

In FIG. 4, the cable 30, which transmits a mechanical force toward the latch mechanism 22 side in response to operation of the push button 29 disposed on the inside handle 21 of the front side door D, is formed by inserting an inner cable 93 into an outer cable 92, and an end part on the latch mechanism 22 side of the outer cable 92 is supported on the case main body 38 of the housing case 36.

A mechanical operating force input lever 95 to which a mechanical latch release operating force from the push button 29 of the inside handle 21 is transmitted is pivotably supported on the cover member 39 of the housing case 36 via a tenth support shaft 96.

The mechanical operating force input lever 95 integrally has a link arm portion 95*a*, an end part of the inner cable 93 projecting from the outer cable 92 being linked to an extremity of the link arm portion 95*a*, and the mechanical operating force input lever 95 is pivotably supported on the cover member 39 via the tenth support shaft 96 while the majority thereof, excluding the extremity of the link arm portion 95*a*, is disposed inside the cover member 39.

The extremity of the link arm portion 95*a* projects outwardly from the cover member 39, and the inner cable 93 is linked to the extremity of the link arm portion 95*a*. When the cable 30 is pulled in response to operation of the push button 29 disposed on the inside handle 21 of the front side door D, the mechanical operating force input lever 95 pivots around the axis of the tenth support shaft 96 in the counterclockwise direction in FIG. 4.

Referring again to FIG. 8 to FIG. 10, a latch release operating lever 97 that is operatively linked to the mechanical operating force input lever 95 and pivots together with the mechanical operating force input lever 95 is pivotably supported on the case main body 38 of the housing case 36 via an eleventh support shaft 98 coaxial with the tenth support shaft 96, and this latch release operating lever 97 is provided integrally with a link arm portion 97*a* linked to a lower end part of a vertically extending coupling link 101 via a link pin 102, and a detection arm portion 97*b* extending to the side opposite to the link arm portion 97*a*.

A torsion spring 103 is provided between the link arm portion 97*a* and the lower end part of the coupling link 101, the coupling link 101 is urged so as to pivot in the counterclockwise direction in FIG. 8 to FIG. 10 around the axis of the link pin 102, and the end of pivoting of the coupling link 101 in the direction in which it is pivotingly urged by the torsion spring 103 is restricted by it abutting against the first locking lever 84. Furthermore, the first locking lever 84 is operatively linked to an intermediate part of the coupling link 101 when the coupling link 101 moves upwardly from the lowest position only by a predetermined stroke, and when the coupling link 101 moves further upward, the first locking lever 84 and the second locking lever 86 are pivoted in the counterclockwise direction in FIG. 8 to FIG. 10.

A second cancel lever 100 is pivotably supported on the case main body 38 above the open link 54, the release link 55, and the first cancel lever 56 via a twelfth support shaft 99. This second cancel lever 100 integrally has a pressing arm portion 100*a* opposing the latching plate part 64 of the first cancel lever 56 from the guide wall 60 side, and a link arm portion 100*b* positioned above the coupling link 101, and an extremity of the link arm portion 100*b* and a longitudinally intermediate part of the open link 54 are linked via a cancel link 104. When the coupling link 101 is pushed upward, the upper end of the coupling link 101 abuts against the extremity of the link arm portion 100*b* of the second cancel lever 100 to thus push the link arm portion 100*b* upward, the latching plate part 64 is pushed by the pressing arm portion 100*a* to thus put the first cancel lever 56 in an inclined attitude, and the open link 54 is pulled upward.

A pair of latch release intention detection switches 118 and 119 are mounted on the latch mechanism 22, the latch release intention detection switches 118 and 119 detecting that the push button 29 disposed on the inside handle 21 of the front side door D has been operated and actuating the latch release electric motor 24.

The two latch release intention detection switches 118 and 119 detect the detection arm portion 97*b* of the latch release operating lever 97, which is operatively linked to the mechanical operating force input lever 95 linked to the cable 30 pulled by pushing the push button 29 of the inside handle 21 and pivots together with the mechanical operating force input lever 95; one latch release intention detection switch 118 is disposed at a position in which it is pushed by the detection arm portion 97*b* when the latch release operating lever 97 is pivoted by pushing the push button 29, and the other latch release intention detection switch 119 is disposed at a position in which it is not pushed by the detection arm portion 97*b* when the latch release operating lever 97 pivots but it is pushed by the detection arm portion 97*b* when the push button 29 is in a non-operated state and the latch release operating lever 97 does not pivot. That is, in a state in which one latch release intention detection switch 118 is in an ON state and the other latch release intention detection switch 119 is in an OFF state, it is confirmed that a vehicle driver has pushed the push button 29 in order to release the latched state.

When a single latch release intention detection switch is used, the switch could automatically turn ON due, for example, to a system failure, and the latch release electric motor 24 would be undesirably actuated, but providing two latch release intention detection switches 118 and 119 as described above for redundancy enables the occurrence of undesirable actuation of the latch release electric motor 24 to be prevented.

Furthermore, an initial position cam switch 120 and a ratchet release position cam switch 121 for detecting the pivoting position of the cam 71 together with the worm wheel 69 in response to actuation of the latch release electric motor 24 are mounted on the case main body 38 at positions around the worm wheel 69 with a gap therebetween. The initial position cam switch 120 is for determining the initial position of the latch release electric motor 24, and in a state in which the latch release electric motor 24 is at the initial position the ratchet 41 is at the ratchet engagement position. The ratchet release position cam switch 121 is disposed so as to detect a predetermined pivoting position for the cam 71 corresponding to the ratchet release position of the ratchet 41, in order that actuation of the latch release electric motor 24 is continued until the unlatched switch 49 detects an unlatched state when the latch release electric motor 24 is actuated so as to move the ratchet 41 to the ratchet release position.

Figure 11:
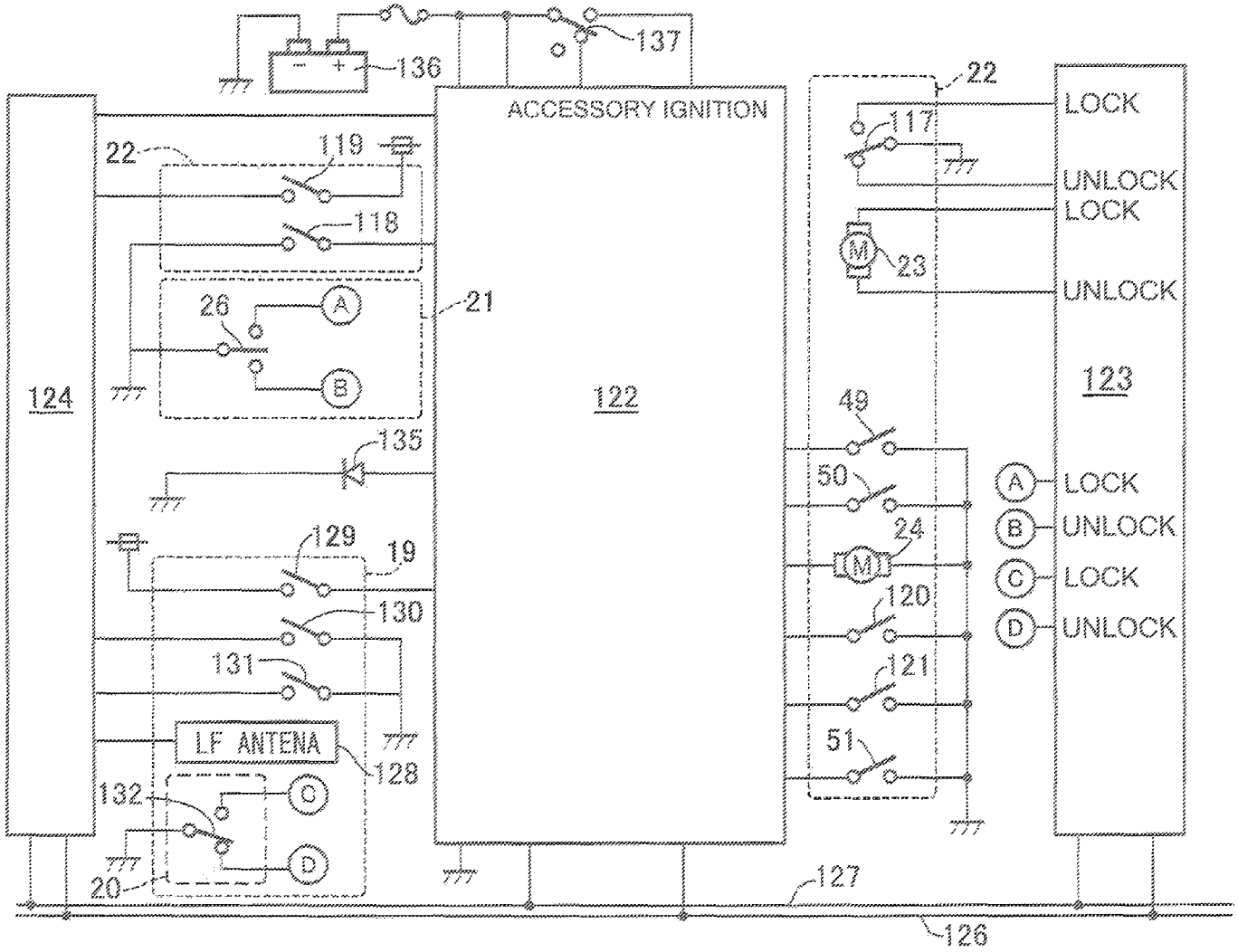
FIG. 11 is a diagram showing the arrangement of a control system. (first embodiment)

In FIG. 11, actuation of the latch release electric motor 24 is controlled by a latch control unit 122, actuation of the lock/unlock switching electric motor 23 is controlled by a central control unit 123, and the latch control unit 122 and the central control unit 123 are connected to a smart control unit 124 via a CAN-H line 126 and a CAN-L line 127.

Installed within the outside handle 19 is an LF antenna 128 for sending and receiving a signal to and from a portable apparatus carried by the vehicle user, disposed within the outside handle 19 are two unlock switches 129 and 130 that attain an ON state when a predetermined position of the outside handle 19 is gripped and a lock switch 131 that attains an ON state when another predetermined position of the outside handle 19 is gripped, and provided on the cylinder lock 20 attached to the out handle 19 is a key switch 132 for detecting whether the cylinder lock 20 has been operated toward the lock side or the unlock side.

Inputted into the latch control unit 122 are ON/OFF signals from the unlatched switch 49, the fully-latched switch 50, the ratchet switch 51, the latch release intention detection switch 118, the initial position cam switch 120, and the ratchet release position cam switch 121, which are disposed within the casing 35 of the latch mechanism 22, and the unlock switch 129.

Connected to the smart control unit 124 is the LF antenna 128, and inputted into the smart control unit 124 are ON/OFF signals from the latch release intention detection switch 119, which is disposed within the casing 35 of the latch mechanism 22, and from the unlock switch 130 and the lock switch 131, which are provided on the outside handle 19.

Inputted into the central control unit 123 are a signal showing which of the locked state and the unlocked state is being detected by the lock/unlock detection switch 117 disposed within the casing 35 of the latch mechanism 22, a signal showing which of the locked state and the unlocked state is being detected by the lock/unlock switching switch 26 provided on the inside handle 21, and a signal showing to which of the lock side and the unlock side the key switch 132 attached to the cylinder lock 20 is being operated.

When the front side door D is closed and in the locked state, if a vehicle user grips the outside handle 19 and the unlock switches 129 and 130 attain an ON state, sending and receiving of an ID signal are carried out wirelessly between the portable apparatus carried by the vehicle user and the LF antenna 128; if it is confirmed by the ID signal that the vehicle user is legitimate, the lock/unlock switching electric motor 23 actuates and attains the unlocked state, and in the unlocked state the latch release electric motor 24 actuates and releases the latched state.

The reason why the two unlock switches 129 and 130 are provided on the outside handle 19 is for imparting redundancy in the same manner as for the two latch release intention detection switches 118 and 119 disposed on the latch mechanism 22; when a single unlock switch is used, the switch could for example automatically turn ON due to a system failure, and the latch release electric motor 24 would be undesirably actuated, but providing the two unlock switches 129 and 130 as described above enables undesirable actuation of the latch release electric motor 24 to be prevented.

The latch control unit 122 controls energization of one light-emitting diode 135 as electric display means for displaying by energization that the latch mechanism 22 is in the unlocked state, based on the output from at least the lock/unlock detection switch 117; power from a battery 136 is supplied to the latch control unit 122, and power from the battery 136 is also supplied to the smart control unit 124 via the latch control unit 122.

The light-emitting diode 135 is disposed on the inner face side of the front side door D such that the light-emitting diode 135 is visible from the outside of the vehicle when the front side door D is in the closed state, and in this embodiment as shown in FIG. 1 the light-emitting diode 135 is disposed in a lower edge part of a window 138 of the inner face of the front side door D.

Furthermore, in FIG. 1, an engine switch 137 is disposed on a dashboard 139 disposed in a front part within the vehicle compartment 17, the engine switch 137 being a switch pushed by the driver seated on the driver's seat 18 so as to switch between a power source OFF state in which energization of in-vehicle equipment that is activated by energization is cut off and a power source ON state in which energization of the in-vehicle equipment is enabled. The engine switch 137 can switch between a state in which energization of accessories mounted on the vehicle is enabled and an ignition coil of an engine is energized, a state in which energization of the accessories is enabled but energization of the ignition coil is cut off, and a state in which energization of the accessories and the ignition coil is cut off, and this engine switch 137 is disposed between the battery 136 and the latch control unit 122 as shown in FIG. 11.

When the engine switch 137 is in the switching mode in which energization of the accessories is enabled and the ignition coil of the engine is energized an ignition terminal of the latch control unit 122 is electrically connected to the battery 136, and when the engine switch 137 is in the switching mode in which energization of the accessories is enabled but energization of the ignition coil is cut off an accessory terminal of the latch control unit 122 is electrically connected to the battery 136; the latch control unit 122 determines that a state in which either the ignition terminal or the accessory terminal is electrically connected to the battery 136 is a power source ON state and determines that a state in which both the ignition terminal and the accessory terminal are cut off from the battery 136 is a power source OFF state.

Moreover, in the power source OFF state the latch control unit 122 starts energization of the light-emitting diode 135 at the time of switching when switching of the lock/unlock detection switch 117 from the locked state to the unlocked state is detected, so as to turn ON the light-emitting diode 135, and then cuts off energization of the light-emitting diode 135 after a first predetermined time, for example one minute, has passed from the time of switching; in the power source ON state, as long as the lock/unlock detection switch 117 detects that there is the unlocked state the latch control unit 122 continues the energized state of the light-emitting diode 135 even after the first predetermined time has elapsed.

Figure 12:
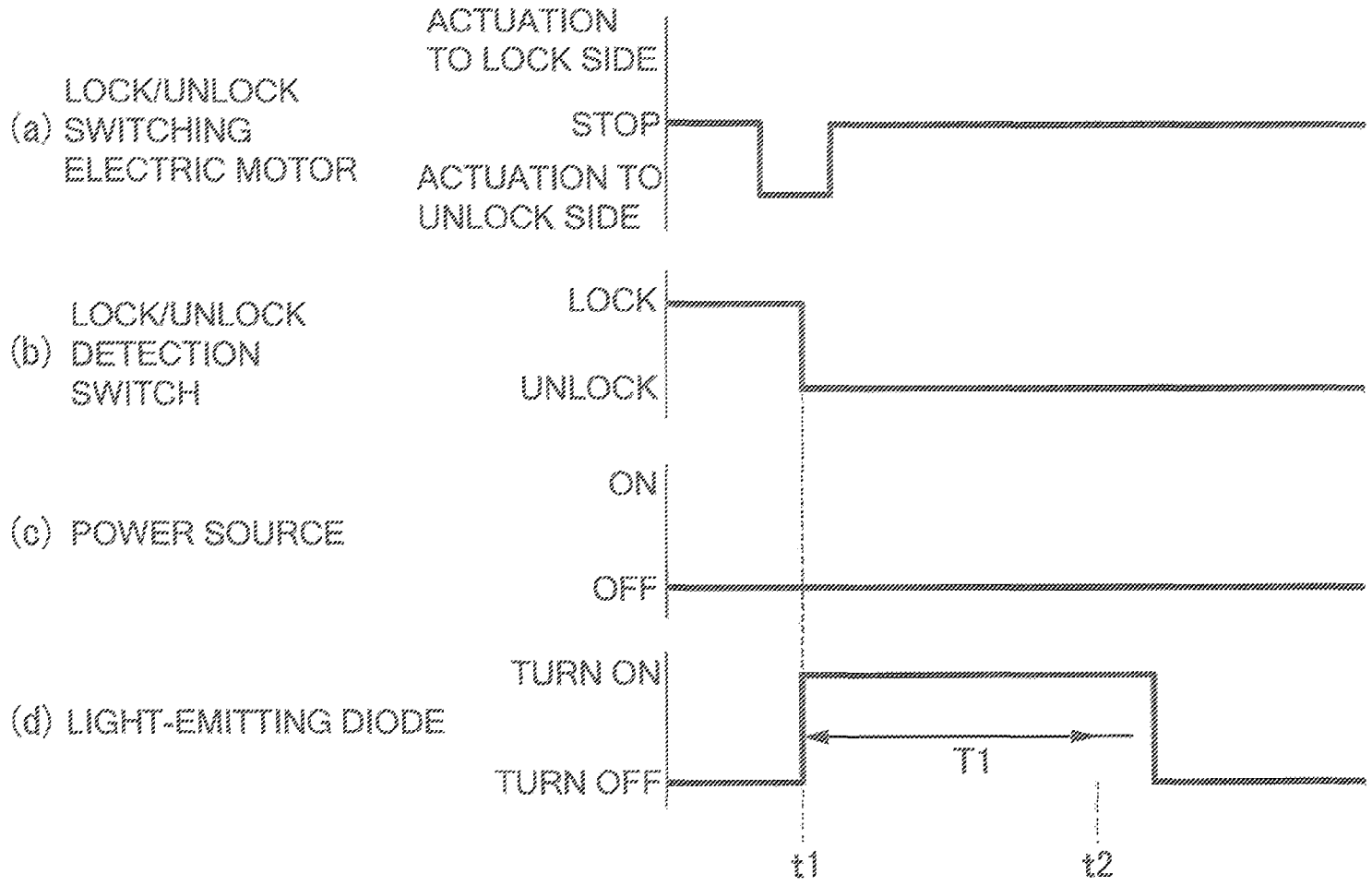
FIG. 12 is a timing chart for explaining display control when changing from a locked state to the unlocked state in a power source OFF state. (first embodiment)

Control of such energization of the light-emitting diode 135 by means of the latch control unit 122 is explained by reference to FIG. 12 to FIG. 15; first, as shown in FIG. 12 when the power source is OFF, the lock/unlock switching electric motor 23 actuates to the unlock side, in response thereto the lock/unlock detection switch 117 detects switching from the locked state to the unlocked state at a time t1, in response thereto the light-emitting diode 135 is turned ON, and at a time t2 when a first predetermined time T1, for example one minute, has elapsed after the time of turning ON, energization of the light-emitting diode 135 is cut off and the light-emitting diode 135 is turned OFF.

Figure 13:
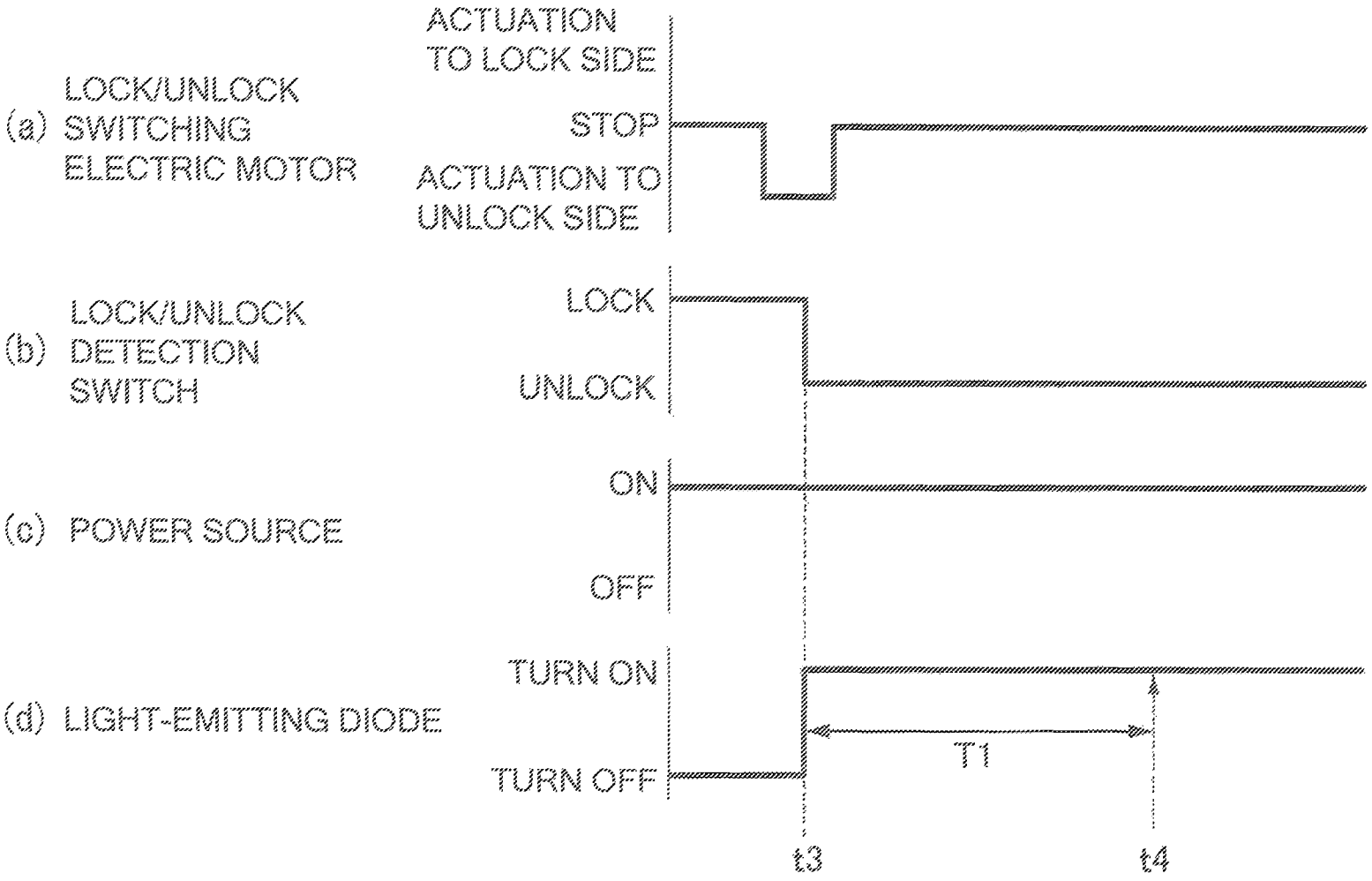
FIG. 13 is a timing chart for explaining display control when changing from the locked state to the unlocked state in a power source ON state. (first embodiment)

Furthermore, as shown in FIG. 13, when the power source is in the ON state, the lock/unlock switching electric motor 23 actuates to the unlock side, in response thereto the lock/unlock detection switch 117 detects switching from the locked state to the unlocked state at a time t3, in response thereto the light-emitting diode 135 turns ON; even after a time t4 when the first predetermined time T1 has elapsed after the time of turning ON, if the power source is in the ON state energization of the light-emitting diode 135 is continued, and the light-emitting diode 135 remains turned ON.

Figure 14:
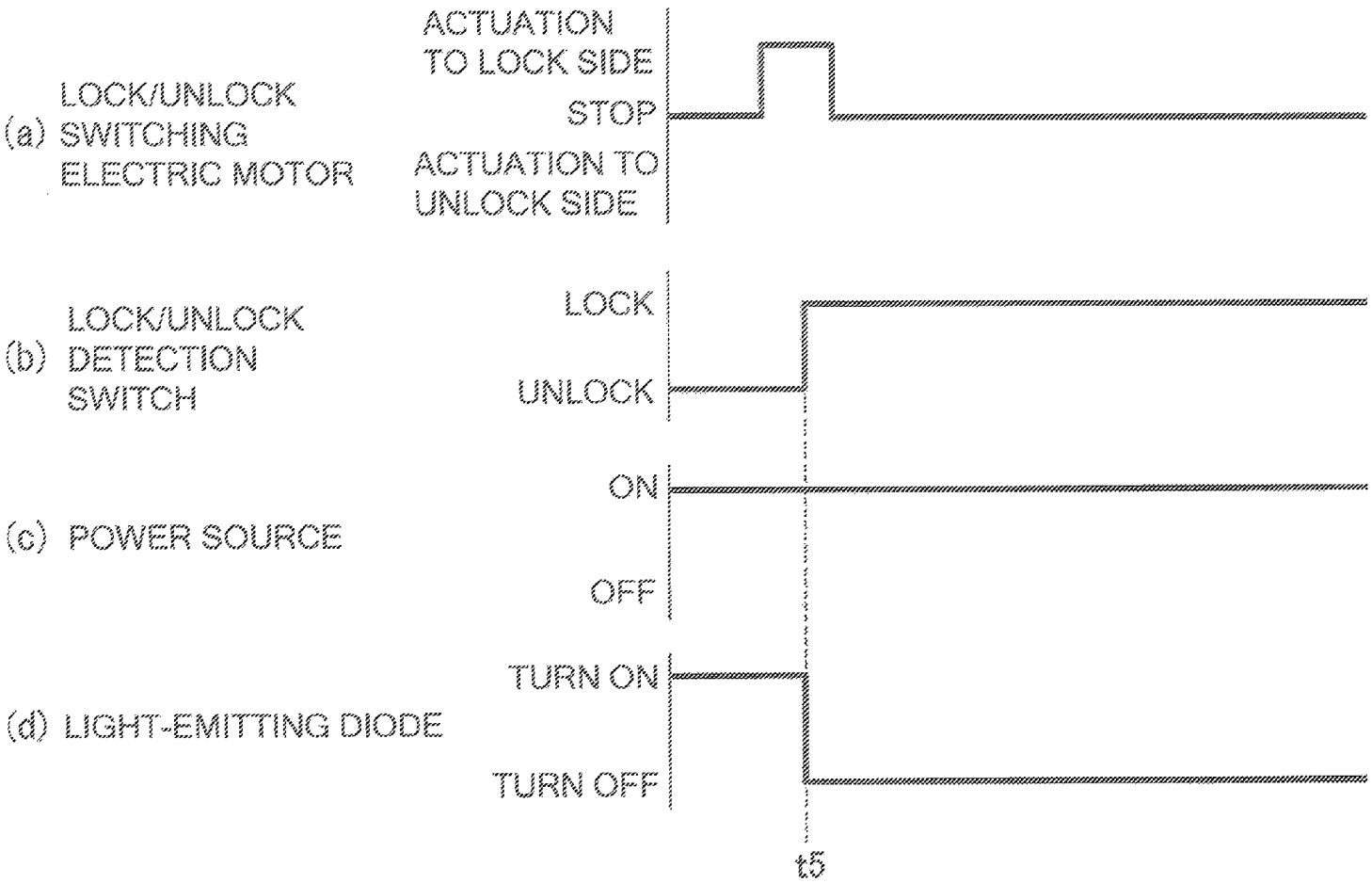
FIG. 14 is a timing chart for explaining display control when changing from the unlocked state to the locked state in a light-emitting diode ON state. (first embodiment)

Moreover, as shown in FIG. 14, when the power source is in the ON state and the lock/unlock detection switch 117 detects the unlocked state, the light-emitting diode 135 remains turned ON; in that state the lock/unlock switching electric motor 23 actuates toward the lock side, in response thereto the lock/unlock detection switch 117 detects switching from the unlocked state to the locked state at a time t5, in response thereto energization of the light-emitting diode 135 is cut off, and the light-emitting diode 135 is turned OFF.

Figure 15:
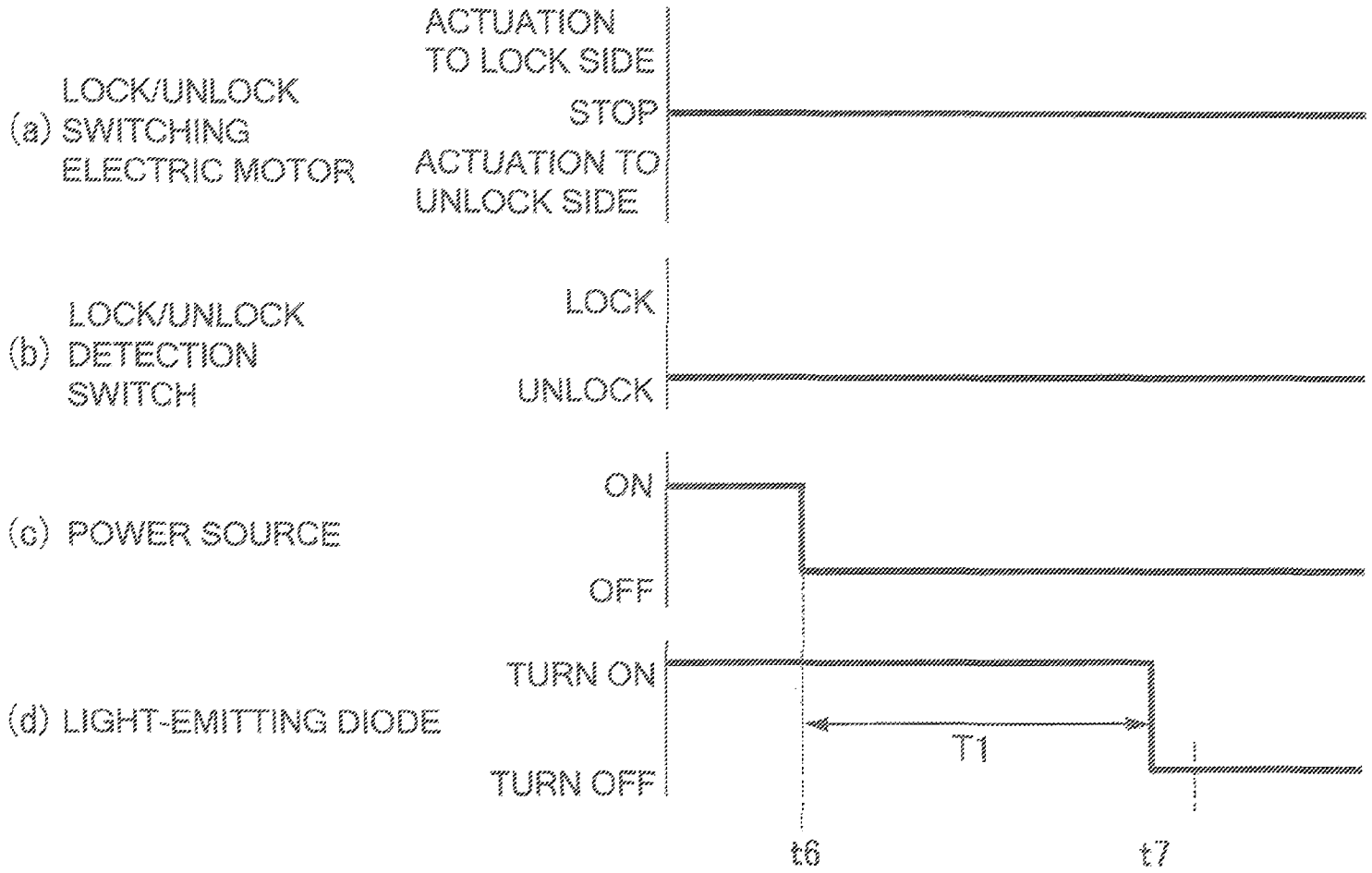
FIG. 15 is a timing chart for explaining display control when the power source OFF state is attained in a light-emitting diode ON state. (first embodiment)

Furthermore, as shown in FIG. 15, when the power source is in the ON state and the lock/unlock detection switch 117 detects the unlocked state, the light-emitting diode 135 remains turned ON, but when the power source OFF state is attained in that state, energization of the light-emitting diode 135 is cut off at a time t7 when the first predetermined time T1 has elapsed after a time t6 when the OFF state is attained, and the light-emitting diode 135 is turned OFF.

Moreover, after the latch release electric motor 24 starts actuation so as to pivot the ratchet 41 from the ratchet engagement position to the ratchet release position, the latch control unit 122 stops actuation of the latch release electric motor 24 when the ratchet release position cam switch 121 detects a predetermined pivoting position for the cam 71 corresponding to the ratchet release position for the ratchet 41; after a second predetermined time, for example five seconds, has elapsed after the actuation stopping, the latch release electric motor 24 is actuated so as to pivot the ratchet 41 to the ratchet engagement position.

Control of such actuation of the latch release electric motor 24 is explained by reference to FIG. 16; at a time t8 when the fully-latched switch 50 is in the ON state in a fully-latched state in which the ratchet 41 is engaged with the latch 40 when the front side door D is completely closed, if the latch release intention detection switches 118 and 119 detect a latch release intention of the vehicle driver, the latch release electric motor 24 actuates so as to pivot the ratchet 41 toward the ratchet release position side, the latched state is released by pivoting of the ratchet 41 in response to the actuation of the latch release electric motor 24, due to the latch 40 urged in the door opening direction being slightly pivoted the fully-latched switch 50 attains the OFF state at a time t9, the ratchet release position cam switch 121 attains the ON state at the subsequent time t10, in response thereto actuation of the latch release electric motor 24 is stopped, and the ratchet 41 is maintained at the ratchet release position.

At a time t11 when a second predetermined time T2, for example five seconds, has elapsed after the latch release electric motor 24 has stopped, the latch release electric motor 24 starts actuating so as to pivot the ratchet 41 toward the ratchet engagement position side, after the ratchet release position cam switch 121 turns OFF at a time t12 accompanying actuation of the latch release electric motor 24 and when the initial position cam switch 120 in the OFF state attains an ON state for a short time and then attains an OFF state at a time t13, actuation of the latch release electric motor 24 is stopped.

Whereas an actuation time T3 of the latch release electric motor 24 in order to pivot the ratchet 41 from the ratchet engagement position to the ratchet release position is for example 0.07 seconds, an actuation time T4 of the latch release electric motor 24 in order to pivot the ratchet 41 from the ratchet release position to the ratchet engagement position is for example 0.12 seconds, and thus T3<T4. Actuation of the latch release electric motor 24 when pivoting from the ratchet engagement position to the ratchet release position is stopped in response to the ratchet release position cam switch 121 turning ON, whereas the setting is such that actuation of the latch release electric motor 24 when pivoting the ratchet 41 from the ratchet release position to the ratchet engagement position is stopped in response to the initial position cam switch 120 in the OFF state attaining the ON state for a short time and then the OFF state, and when maintaining the ratchet 41 at the ratchet engagement position the initial position cam switch 120 is prevented from being continuously in the ON state and wasting power.

Figure 16:
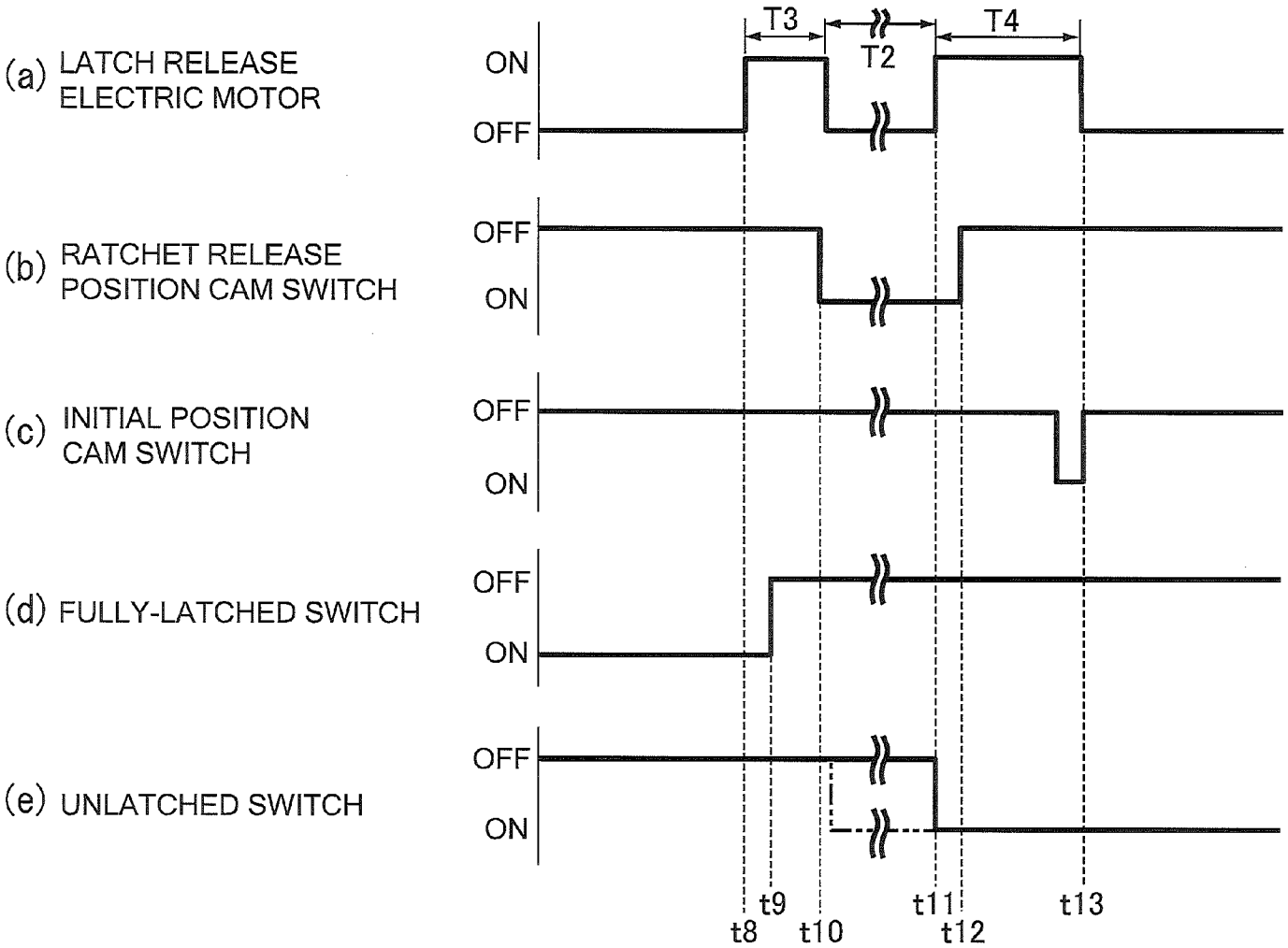
FIG. 16 is a timing chart for explaining actuation control of a latch release electric motor. (first embodiment)

Furthermore, when as shown by the chain line of FIG. 16 the unlatched switch 49 detects that the front side door D has pivoted from the closed position toward the open side after the latch release electric motor 24 starts actuation so as to pivot the ratchet 41 from the ratchet engagement position to the ratchet release position and before the second predetermined time T2 has elapsed after the ratchet release position cam switch 121 detects that the ratchet 41 is at the ratchet release position and actuation of the latch release electric motor 24 has stopped, the latch control unit 122 immediately actuates the latch release electric motor 24 so as to pivot the ratchet 41 toward the ratchet engagement position side even partway through the passage of the second predetermined time T2.

The operation of this embodiment is now explained; the latch mechanism 22 provided on the front side door D is provided with the lock/unlock switching electric motor 23, which exerts power that can switch between the unlocked state in which release of the latched state is enabled and the locked state in which release of the latched state is disabled, and the lock/unlock detection switch 117, which detects whether the latch mechanism 22 is in the unlocked state or the locked state, energization of the light-emitting diode 135, which displays by being energized that the latch mechanism 22 is in the unlocked state, being controlled by the latch control unit 122 based on at least the output of the lock/unlock detection switch 117; in the power source OFF state in which energization of in-vehicle equipment, which is activated by energization, is cut off, this latch control unit 122 cuts off energization of the light-emitting diode 135, for which energization starts at the time of switching when the lock/unlock detection switch 117 has detected switching from the locked state to the unlocked state, after the first predetermined time T1 has elapsed from the time of switching, whereas in the power source ON state in which energization of the in-vehicle equipment is enabled, since as long as the lock/unlock detection switch 117 detects that there is the unlocked state the energized state of the light-emitting diode 135 is continued even after the first predetermined time T1 has elapsed, it is possible to avoid erroneous recognition of the front side door D in the unlocked state being in the locked state as a result of it becoming unknown whether the front side door D is in the unlocked state or the locked state after the first predetermined time T1 has elapsed since the time of turning ON of the light-emitting diode 135, thereby preventing the front side door D from opening undesirably.

Furthermore, since the electric display means is formed from one light-emitting diode 135, it is possible to easily ensure that there is space for disposing the electric display means while reducing power consumption. Moreover, since the light-emitting diode 135 is disposed on the inner face side of the front side door D such that it is visible from the outside of the vehicle when the front side door D is in the closed state, it is possible to easily confirm the unlocked state and the locked state from the outside of the vehicle due to the light-emitting diode 135 being made visible from the outside of the vehicle.

Furthermore, the ratchet 41 at the ratchet engagement position can engage with the latch 40, which can engage with the striker 33 on the vehicle body side in response to pivoting of the front side door D to the closed side in the completely closed state and the half-shut state of the front side door D. Actuation of the latch release electric motor 24 for pivoting the ratchet 41 between the engagement position and the ratchet release position, at which engagement with the latch 40 is released, is controlled by the latch control unit 122 such that, in the fully-latched state in which the ratchet 41 is engaged with the latch 40 when the front side door D is completely closed, in response to the latch release intention detection switches 118 and 119 detecting an intention of a vehicle driver to release latch, the ratchet 41 is pivoted from the ratchet engagement position to the ratchet release position. The latch control unit 122 actuates the latch release electric motor 24 so as to pivot the ratchet 41 to the ratchet engagement position after the second predetermined time T2 has elapsed since the ratchet release position cam switch 121 has detected that the ratchet 41 is at the ratchet release position and actuation of the latch release electric motor 24 has been stopped after the latch release electric motor 24 has started actuating so as to pivot the ratchet 41 from the ratchet engagement position to the ratchet release position. Therefore, even if the push button 29 of the inside handle 22 is erroneously operated in the unlocked state of the latch mechanism 22, after the second predetermined time T2 has elapsed, the ratchet 41 can be engaged with the latch 40 to thus put the front side door D in a half-shut state, thus preventing as far as possible the front side door D from opening undesirably.

Moreover, when the unlatched switch 49 detects that the front side door D has pivoted to the open side before the second predetermined time T2 has elapsed since the ratchet release position cam switch 121 has detected that the ratchet 41 is at the ratchet release position and actuation of the latch release electric motor 24 has been stopped, the latch control unit 122 immediately actuates the latch release electric motor 24 so as to pivot the ratchet 41 toward the ratchet engagement position side. Because of this, if the ratchet 41 were at the ratchet release position when the front side door D had closed (quickly closed) before the second predetermined time T2 had elapsed after the latched state had been released and the front side door D had been opened, the front side door D could not be maintained in the closed state, but even when the front side door D is quickly closed the ratchet 41 can be made to engage with the latch 40, thus maintaining the closed state of the front side door D.

An embodiment of the present invention is explained above, but the present invention is not limited to the above embodiment and may be modified in a variety of ways as long as the modifications do not depart from the spirit and scope thereof.

For example, in the embodiment above, a case in which as the ratchet release position detection means the ratchet release position cam switch 121 is used is explained, but the ratchet switch 51, which directly detects the ratchet 41 at the ratchet release position, may be used as the ratchet release position detection means.

The invention claimed is:

1. A vehicle door latch mechanism for a vehicle door, comprising:

a latch configured to selectively engage with a striker on a vehicle body side, a ratchet configured to selectively operate between:

a ratchet engagement position in which engagement with the latch in a completely closed state and a half-shut state of the door is enabled and a ratchet release position in which engagement with the latch is released, a latch release electric motor configured to exert power for driving the ratchet between the ratchet engagement position and the ratchet release position, latch release intention detection means that detects a latch release intention of a vehicle door operator, ratchet release position detection means that detects a state in which the ratchet is at the ratchet release position, and a control unit configured to:

determine, from the latch release intention detection means, a latch release intention of the vehicle door operator when the door is in a fully-latched state in which the ratchet is engaged with the latch when the door is completely closed, control actuation of the latch release electric motor so as to pivot the ratchet from the ratchet engagement position to the ratchet release position in response to determining the latch release intention, determine that the ratchet is at the ratchet release position from ratchet release position detection means, measure an amount of elapsed time starting from the determination that the ratchet is at the ratchet release position and the stopping of the actuation of the latch release electric motor, and control actuation of the latch release electric motor so as to pivot the ratchet to the ratchet engagement position once the amount of elapsed time reaches a predetermined time.

2. The vehicle door latch mechanism according to claim 1, further comprising:

door open detection means that detects that the door has opened, and wherein the control unit is further configured to:

determine that the door has opened from the door opening detection means, and in a case in which it is determined that the door has opened at a time prior to the predetermined time, immediately controlling actuation of the latch release electric motor so as to pivot the ratchet toward the ratchet engagement position.

* * * * *